US010137690B2

(12) United States Patent
Hirokawa et al.

(10) Patent No.: US 10,137,690 B2
(45) Date of Patent: Nov. 27, 2018

(54) INK JET RECORDING APPARATUS AND INK JET RECORDING METHOD

(71) Applicant: CANON KABUSHIKI KAISHA, Tokyo (JP)

(72) Inventors: Ryosuke Hirokawa, Kawasaki (JP); Toru Yamane, Yokohama (JP); Akihiro Mouri, Fuchu (JP); Hiroaki Motooka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/411,635

(22) Filed: Jan. 20, 2017

(65) Prior Publication Data

US 2017/0217191 A1 Aug. 3, 2017

(30) Foreign Application Priority Data

Jan. 29, 2016 (JP) ..... 2016-016564

(51) Int. Cl.

| | |
|---|---|
| ***B41J 2/165*** | (2006.01) |
| ***B41J 11/00*** | (2006.01) |
| ***B41J 29/17*** | (2006.01) |
| ***B41J 29/38*** | (2006.01) |

(52) U.S. Cl.

CPC ..... *B41J 2/16523* (2013.01); *B41J 11/0015* (2013.01); *B41J 29/17* (2013.01); *B41J 29/38* (2013.01)

(58) Field of Classification Search

CPC ..... B41J 2/16523; B41J 29/17; B41J 29/38; B41J 11/0015

USPC ..... 347/31

See application file for complete search history.

(56) References Cited

U.S. PATENT DOCUMENTS

| | | | |
|---|---|---|---|
| 7,374,265 | B2 | 5/2008 | Yamane et al. |
| 7,419,257 | B2 | 9/2008 | Mouri et al. |
| 7,494,213 | B2 | 2/2009 | Taniuchi et al. |
| 7,533,954 | B2 | 5/2009 | Nakazawa et al. |
| 7,537,308 | B2 | 5/2009 | Yamane |
| 7,695,088 | B2 | 4/2010 | Yamane et al. |
| 7,926,933 | B2 | 4/2011 | Taniuchi et al. |
| 7,997,717 | B2 | 8/2011 | Taniuchi et al. |
| 8,220,917 | B2 | 7/2012 | Taniuchi et al. |
| 8,342,647 | B2 | 1/2013 | Yamane et al. |

(Continued)

FOREIGN PATENT DOCUMENTS

| | | |
|---|---|---|
| JP | 2001-179959 A | 7/2001 |
| JP | 2009-45851 A | 3/2009 |
| JP | 2009-61644 A | 3/2009 |

OTHER PUBLICATIONS

U.S. Appl. No. 15/413,970, filed Jan. 24, 2017. Applicants: Toru Ohnishi, et al.

*Primary Examiner* — Huan Tran
*Assistant Examiner* — Alexander D Shenderov
(74) *Attorney, Agent, or Firm* — Fitzpatrick, Cella, Harper & Scinto

(57) ABSTRACT

An ink jet recording apparatus includes a liquid collecting device including a compression member configured to compress a first porous body from a second surface opposite to a first surface that comes into contact with a first image, to extrude and collect a liquid component containing a first liquid from the first surface of the first porous body, and the liquid collecting device includes a second porous body configured to absorb the liquid component extruded from the first surface of the first porous body.

27 Claims, 8 Drawing Sheets

(56) References Cited

U.S. PATENT DOCUMENTS

| | | | | |
|---|---|---|---|---|
| 2003/0030693 | A1* | 2/2003 | Kawano | B41J 2/16508 347/36 |
| 2003/0066751 | A1* | 4/2003 | May | B41J 2/01 204/483 |
| 2003/0067528 | A1* | 4/2003 | Chowdry | B41J 2/04 347/103 |

* cited by examiner

INK JET RECORDING APPARATUS AND INK JET RECORDING METHOD

BACKGROUND OF THE INVENTION

Field of the Invention

The present invention relates to an ink jet recording apparatus and an ink jet recording method.

Description of the Related Art

In an ink jet recording method, a liquid composition containing a coloring material (ink) is directly or indirectly applied onto a recording medium such as paper to form an image. During the process, the recording medium may excessively absorb a liquid component in the ink, thereby causing curing or cockling.

In order to immediately remove the liquid component in an ink to suppress such trouble, there are a method of drying a recording medium by using warm air, infrared light, or a similar technique and a method in which an image is formed on a transfer body, then a liquid component contained in the image on the transfer body is dried by thermal energy or the like, and the image is transferred to a recording medium such as paper. Another method is disclosed as the technique of removing the liquid component contained in an image on a transfer body without using thermal energy. In the method, a roller-like porous body is brought into contact with an ink image to absorb and remove the liquid component from the ink image (Japanese Patent Application Laid-Open No. 2009-45851).

As a method of further collecting the liquid absorbed by a porous body, Japanese Patent Application Laid-Open No. 2009-61644 discloses a collecting system using a negative pressure. Although a negative pressure collecting system may cause insufficient liquid collection due to an air leak, the disclosed method enables efficient liquid collection by filling a porous body with a liquid before liquid collection to prevent air from leaking. In addition, Japanese Patent Application Laid-Open No. 2001-179959 discloses a system for achieving high filtering performance (preventing an ink coloring material from adhering). In the system, a porous body including a filter layer having a small pore diameter is used to absorb and remove a liquid component from an ink, and the liquid absorbed by the porous body is squeezed by using a roller or a blade.

Studies by the inventors of the present invention, however, have revealed that such a liquid collection system using a negative pressure as disclosed in Japanese Patent Application Laid-Open No. 2009-61644 requires a massive energy load. In addition, when such a porous body with a small pore diameter as disclosed in Japanese Patent Application Laid-Open No. 2001-179959 is particularly used as an absorber, the flow resistance may become too large to collect the liquid. Meanwhile, in the system using such a roller or a blade as disclosed in Japanese Patent Application Laid-Open No. 2001-179959 to squeeze a liquid component, no energy load is required, but the liquid squeezed out of an absorber may insufficiently move to the roller or blade or may return to the absorber. Especially during high speed conveyance, the liquid is difficult to collect.

SUMMARY OF THE INVENTION

An aspect of the present invention provides an ink jet recording apparatus including an image forming unit configured to form a first image containing a first liquid and a coloring material on an ink receiving medium, a liquid absorbing member including a first porous body having a first surface configured to come into contact with the first image to absorb at least some of the first liquid from the first image, and a liquid collecting device including a compression member configured to compress the first porous body from a second surface opposite to the first surface to extrude and collect a liquid component containing the first liquid from the first surface of the first porous body, wherein the liquid collecting device includes a second porous body configured to absorb the liquid component extruded from the first surface.

Another aspect of the present invention provides an ink jet recording method including a forming step of forming a first image containing a first liquid and a coloring material on an ink receiving medium, a liquid absorbing step of bringing a first surface of a first porous body of a liquid absorbing member into contact with the first image to allow the first porous body to absorb at least some of the first liquid from the first image, and a liquid collecting step of compressing the first porous body from a second surface opposite to the first surface by a compression member to extrude and collect a liquid component containing the first liquid from the first surface of the first porous body, wherein the liquid collecting step includes absorbing and collecting the liquid component extruded from the first surface of the first porous body, by using a liquid collecting member including a second porous body.

Further features of the present invention will become apparent from the following description of exemplary embodiments with reference to the attached drawings.

DESCRIPTION OF THE EMBODIMENTS

Figure 1:
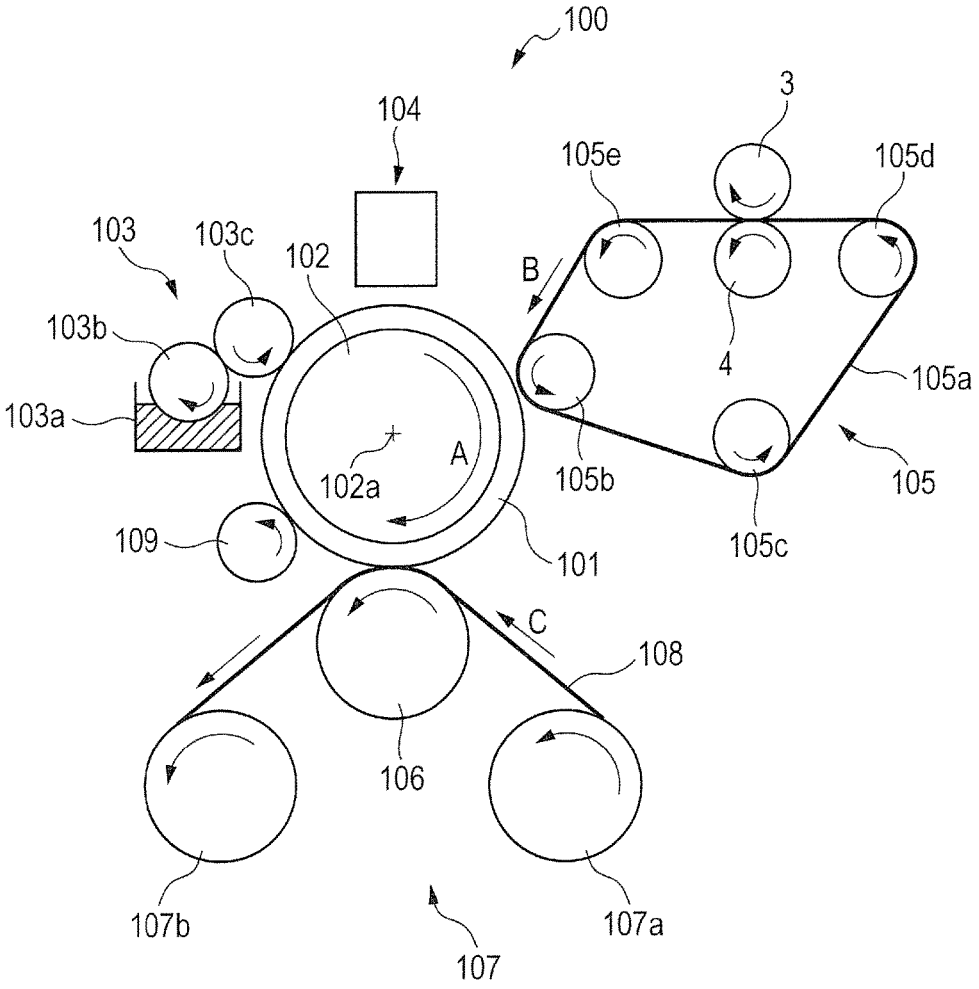
FIG. 1 is a schematic view showing an exemplary structure of a transfer type ink jet recording apparatus according to an embodiment of the present invention.

Preferred embodiments of the present invention will now be described in detail in accordance with the accompanying drawings.

An ink jet recording apparatus of the present embodiment includes an image forming unit configured to form a first image containing a first liquid and a coloring material on an ink receiving medium, and a liquid absorbing member including a first porous body having a first surface configured to come into contact with the first image to absorb at least some of the first liquid from the first image. By bringing the liquid absorbing member including the first porous body into contact with the first image containing a first liquid and a coloring material on an ink receiving medium, at least some of the first liquid is removed from the first image. This prevents a recording medium such as paper from excessively absorbing the first liquid in the first image, thereby suppressing curing or cockling.

The ink jet recording apparatus of the present embodiment is characterized by further including a liquid collecting device that includes a compression member configured to compress the first porous body that has absorbed the liquid from the first image, from a second surface opposite to the first surface to extrude and collect a liquid component containing the first liquid from the first surface of the first porous body. The liquid collecting device includes a liquid collecting member including a second porous body configured to collect the liquid component extruded from the first surface. Absorption and collection of the liquid component by using the second porous body from the first porous body that has absorbed the liquid from the first image enables efficient liquid collection even during high speed conveyance.

In the ink jet recording apparatus of the present embodiment, the image forming unit may be any image forming unit that enables the formation of a first image containing a first liquid and a coloring material on an ink receiving medium. Preferred is an image forming unit that includes 1) a device of applying a first liquid composition containing the first liquid or a second liquid onto an ink receiving medium and 2) a device of applying a second liquid composition containing the first liquid or a second liquid and the coloring material onto the ink receiving medium and forms a first image as a mixture of the first liquid composition and the second liquid composition. Typically, the second liquid composition is an ink containing a coloring material, and the device of applying the second liquid composition onto an ink receiving medium is an ink jet recording device. The first liquid composition contains a component that chemically or physically interacts with the second liquid composition to viscously thicken a mixture of the first liquid composition and the second liquid composition as compared with each of the first liquid composition and the second liquid composition. At least one of the first and second liquid compositions contains the first liquid. Here, the first liquid contains a liquid having a low volatility at normal temperature (room temperature) and especially contains water. The second liquid is a liquid other than the first liquid, and may have any volatility, but is preferably a liquid having a higher volatility than that of the first liquid. Hereinafter, the first liquid composition is called "reaction liquid", and the device of applying the first liquid composition onto an ink receiving medium is called "reaction liquid applying device". The second liquid composition is called "ink", and the device of applying the second liquid composition onto an ink receiving medium is called "ink applying device". The first image is an ink image before the liquid removal in the liquid absorbing step, and the second image is an ink image after the liquid removal in the liquid absorbing step by which the content of an aqueous liquid component (first liquid) is reduced.

<Reaction Liquid Applying Device>

The reaction liquid applying device may be any device capable of applying a reaction liquid onto an ink receiving medium, and conventionally known various devices can be appropriately used. Specific examples of the device include a gravure offset roller, an ink jet head, a die coating device (die coater), and a blade coating device (blade coater). The application of a reaction liquid by the reaction liquid applying device may be performed either before the application of an ink or after the application of an ink as long as the reaction liquid can be mixed (reacted) with an ink on an ink receiving medium. Preferably, the reaction liquid is applied before the application of an ink. The application of a reaction liquid before the application of an ink enables suppression of bleeding, which is caused by mixing of inks applied adjacent to each other, or beading, which is caused by pulling of a previously applied ink by a subsequently applied ink at the time of image recording by the ink jet system.

<Reaction Liquid>

The reaction liquid contains a component that increases the viscosity of an ink (ink-viscosity-increasing component). In other words, by allowing the reaction liquid on an ink receiving medium to come into contact with an ink that is applied after the application of the reaction liquid onto the ink receiving medium, the viscosity of the ink can be increased. Here, the increase in viscosity of an ink is such a phenomenon that when a coloring material, a resin, or the like as a component constituting an ink comes into contact with an ink-viscosity-increasing component, the components are chemically reacted or physically adsorbed, and this causes an increase in viscosity of the ink. The increase in viscosity of an ink includes not only an increase in viscosity of an ink but also a local increase in viscosity by aggregation of some of the components constituting an ink, such as a coloring material and a resin.

The ink-viscosity-increasing component has the effect of lowering the flowability of an ink and/or some of the components constituting an ink on an ink receiving medium to suppress bleeding or beading at the time of first image formation. In the present invention, increasing the viscosity of an ink is also called "viscously thickening an ink". As such an ink-viscosity-increasing component, polyvalent metal ions, organic acids, cation polymers, porous microparticles, and other known materials can be used. Specifically preferred are polyvalent metal ions and organic acids. A plurality of types of ink-viscosity-increasing components can also be preferably contained. The content of the ink-viscosity-increasing component in the reaction liquid is preferably 5% by mass or more relative to the total mass of the reaction liquid.

Examples of the polyvalent metal ion include divalent metal ions such as $Ca^{2+}$, $Cu^{2+}$, $Ni^{2+}$, $Mg^{2+}$, $Sr^{2+}$, $Ba^{2+}$, and $Zn^{2+}$; and trivalent metal ions such as $Fe^{3+}$, $Cr^{3+}$, $Y^{3+}$, and $Al^{3+}$.

Examples of the organic acid include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, oxysuccinic acid, and dioxysuccinic acid.

The reaction liquid can contain water or a low volatile organic solvent in an appropriate amount as the first liquid. The water used in this case is preferably a deionized water prepared by ion exchanging, for example. The organic solvent used in the reaction liquid to be applied to the present invention is not limited to particular solvents, and a known organic solvent can be used.

To the reaction liquid, a surfactant or a viscosity modifier can be added to appropriately adjust the surface tension or the viscosity thereof, and such a reaction liquid can be used. The material to be used may be any material that can coexist with the ink-viscosity-increasing component. The surfactant specifically used is exemplified by an acetylene glycol ethylene oxide adduct ("Acetylenol E100", trade name manufactured by Kawaken Fine Chemicals) and a perfluoroalkyl ethylene oxide adduct ("MEGAFACE F444", trade name manufactured by DIC Corporation).

<Ink Applying Device>

As the ink applying device for applying an ink, an ink jet head is used. The ink jet head is exemplified by a device that causes film boiling of an ink by an electrothermal converter to form bubbles and discharges the ink, a device that discharges an ink by an electromechanical converter, and a device that discharges an ink by using static electricity. In the present invention, a known ink jet head can be used. Of them, the device using an electrothermal converter can be suitably used, particularly from the viewpoint of high-density printing at high speed. To record an image, the head applies an intended amount of an ink to an intended position upon receiving an image signal.

The ink application amount can be expressed by image density (duty) or ink thickness. In the present embodiment, the mass of each ink dot is multiplied by the number of dots applied (the number of dots discharged), and the result is divided by a printed area to give an average as the ink application amount ($g/m^2$). The maximum ink application amount in an image region represents an ink application amount in an area of at least 5 $mm^2$ or more within a region used as information of an ink receiving medium from the viewpoint of removing the liquid component in an ink.

The ink jet recording apparatus of the present invention can include a plurality of ink jet heads in order to apply various color inks on an ink receiving medium. For example, when a yellow ink, a magenta ink, a cyan ink, and a black ink are used to form a four-color image, the ink jet recording apparatus includes four ink jet heads that each discharges a corresponding ink of the four inks on an ink receiving medium. The ink applying device may further includes an ink jet head that discharges an ink containing no coloring material (clear ink).

<Ink>

Each component of the ink applied to the present invention will be described.

(Coloring Material)

As the coloring material contained in the ink applied to the present invention, a pigment or a mixture of a dye and a pigment can be used. The pigment usable as the coloring material is not limited to particular types. Specific examples of the pigment include inorganic pigments such as carbon black; and organic pigments such as azo pigments, phthalocyanine pigments, quinacridone pigments, isoindolinone pigments, imidazolone pigments, diketopyrrolopyrrole pigments, and dioxazine pigments. These pigments can be used singly or in combination of two or more of them as needed.

The dye usable as the coloring material is not limited to particular types. Specific examples of the dye include direct dyes, acid dyes, basic dyes, disperse dyes, and food dyes, and a dye having an anionic group can be used. Specific examples of the dye skeleton include an azo skeleton, a triphenylmethane skeleton, a phthalocyanine skeleton, an azaphthalocyanine skeleton, a xanthene skeleton, and an anthrapyridone skeleton.

The content of the pigment in the ink is preferably 0.5% by mass or more to 15.0% by mass or less and more preferably 1.0% by mass or more to 10.0% by mass or less relative to the total mass of the ink.

(Dispersant)

As the dispersant for dispersing a pigment, a known dispersant used in an ink jet ink can be used. Specifically, a water-soluble dispersant having both a hydrophilic moiety and a hydrophobic moiety in the structure is preferably used in an embodiment of the present invention. In particular, a pigment dispersant composed of a resin prepared by copolymerizing a mixture containing at least a hydrophilic monomer and a hydrophobic monomer is preferably used. Each monomer used here is not limited to particular monomers, and known monomers are suitably used. Specifically, examples of the hydrophobic monomer include styrene and other styrene derivatives, alkyl (meth)acrylates, and benzyl (meth)acrylate. Examples of the hydrophilic monomer include acrylic acid, methacrylic acid, and maleic acid.

The dispersant preferably has an acid value of 50 mg KOH/g or more to 550 mg KOH/g or less. The dispersant preferably has a weight average molecular weight of 1,000 or more to 50,000 or less. The mass ratio of the pigment and the dispersant (pigment:dispersant) is preferably in a range of 1:0.1 to 1:3.

What is called a self-dispersible pigment that is dispersible due to surface modification of a pigment itself and eliminates the use of the dispersant is also preferably used in the present invention.

(Resin Microparticles)

The ink applied to the present invention can contain various microparticles with no coloring material, and such an ink can be used. Specifically, resin microparticles may have the effect of improving image quality or fixability and are preferred. The material of the resin microparticles usable in the present invention is not limited to particular materials, and known resins can be appropriately used. The material is specifically exemplified by homopolymers such as polyolefin, polystyrene, polyurethane, polyester, polyether, polyurea, polyamide, polyvinyl alcohol, poly(meth)acrylic acid and salts thereof, polyalkyl (meth)acrylate, and polydiene; and copolymers prepared by copolymerizing a plurality of monomers, which are used for forming such a homopolymer, in combination. The resin preferably has a weight average molecular weight (Mw) of 1,000 or more to 2,000,000 or less. In the ink, the content of the resin microparticles is preferably 1% by mass or more to 50% by mass or less and more preferably 2% by mass or more to 40% by mass or less relative to the total mass of the ink.

In an embodiment of the present invention, the resin microparticles are preferably used as a resin microparticle dispersion in which the resin microparticles are dispersed in a liquid. The dispersion technique is not limited to particular techniques. Preferred is what is called a self-dispersion type resin microparticle dispersion in which a resin prepared by homopolymerization of a monomer having a dissociable group or by copolymerization of a plurality of such monomers is dispersed. The dissociable group is exemplified by a carboxyl group, a sulfonic acid group, and a phosphoric acid group, and the monomer having such a dissociable group is exemplified by acrylic acid and methacrylic acid. In addition, what is called an emulsion-dispersion type resin microparticle dispersion in which resin microparticles are dispersed with an emulsifier can be similarly, suitably used in the present invention. As the emulsifier as used herein, a known surfactant is preferred regardless of having a low molecular weight or a high molecular weight. The surfactant is preferably a nonionic surfactant or a surfactant having the same charge polarity as that of resin microparticles.

The resin microparticle dispersion used in an embodiment of the present invention preferably has a dispersion particle diameter of 10 nm or more to 1,000 nm or less and more preferably 100 nm or more to 500 nm or less.

When the resin microparticle dispersion used in an embodiment of the present invention is prepared, various additives are preferably added for stabilization. Examples of the additive include n-hexadecane, dodecyl methacrylate, stearyl methacrylate, chlorobenzene, dodecyl mercaptan, a blue dye (bluing agent), and polymethyl methacrylate.

(Surfactant)

The ink usable in the present invention may contain a surfactant. The surfactant is specifically exemplified by an acetylene glycol ethylene oxide adduct (Acetylenol E100, manufactured by Kawaken Fine Chemicals). In the ink, the content of the surfactant is preferably 0.01% by mass or more to 5.0% by mass or less relative to the total mass of the ink.

(Water and Water-Soluble Organic Solvent)

The ink used in the present invention can contain water and/or a water-soluble organic solvent as the solvent. The water is preferably a deionized water prepared by ion exchanging, for example. In the ink, the content of the water is preferably 30% by mass or more to 97% by mass or less relative to the total mass of the ink, and is more preferably 50% by mass or more to 95% by mass or less relative to the total mass of the ink.

The water-soluble organic solvent to be used is not limited to particular types, and any known organic solvent can be used. Specific examples of the water-soluble organic solvent include glycerol, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol, and methanol. Needless to say, two or more solvents selected from these solvents can be used as a mixture.

In the ink, the content of the water-soluble organic solvent is preferably 3% by mass or more to 70% by mass or less relative to the total mass of the ink.

(Other Additives)

The ink usable in the present invention may contain, in addition to the above components, various additives such as a pH adjuster, an anticorrosive, an antiseptic agent, an antifungal agent, an antioxidant, a reduction inhibitor, a water-soluble resin and a neutralizer thereof, and a viscosity modifier, as needed.

<Liquid Absorbing Member>

In the present invention, a liquid absorbing member including a first porous body is brought into contact with a first image to absorb at least some of a first liquid from the first image, and the content of the liquid component in the first image is reduced. The contact surface of the liquid absorbing member with the first image is regarded as a first surface, and the first porous body is placed on the first surface. Such a liquid absorbing member including the first porous body preferably moves as the ink receiving medium moves, and preferably has such a shape that the liquid absorbing member rotates at a certain cycle after coming into contact with a first image, to come into contact with another first image and can absorb a liquid. The shape is exemplified by an endless-belt shape and a drum shape.

(First Porous Body)

The first porous body of the liquid absorbing member pertaining to the present invention preferably has a smaller average pore diameter on the first surface than the average pore diameter on a second surface opposite to the first surface. In order to suppress adhesion of the coloring material in an ink to the first porous body, the pore diameter is preferably small, and at least the first porous body on the first surface that comes into contact with a first image preferably has an average pore diameter of 10 μm or less. The average pore diameter means an average diameter on the surface of the first surface or the second surface, and can be determined by a known technique such as a mercury intrusion method, a nitrogen adsorption method, and SEM image observation.

In order to evenly achieve high breathability, the first porous body preferably has a small thickness. The breathability can be expressed as Gurley value in accordance with JIS P8117, and the Gurley value is preferably 10 seconds or less. A thin first porous body, however, cannot ensure a capacity sufficient to absorb a liquid component in some cases, and thus the first porous body can have a multilayer structure. In the liquid absorbing member, only the layer to come into contact with the first image is required to be a porous body, and a layer not to come into contact with the first image is not necessarily a porous body.

<Multilayer Structure>

Next, an embodiment in which the first porous body has a multilayer structure will be described. In this explanation, the layer on the side to come into contact with the first image is a first layer, and the layer laminated on the face opposite to the contact surface of the first layer with the first image is a second layer. For a structure including three or more layers, the layers are expressed in the laminating order successively from the first layer. In the present specification, the first layer is also called "absorbing layer", and the second and subsequent layers are also called "support layer".

[First Layer]

In the present invention, the first layer may be made of any material. Any of the hydrophilic materials having a contact angle with water of less than 90° and the water-repellent materials having a contact angle of 90° or more can be used. When used, the hydrophilic material preferably has a contact angle with water of 40° or less. When composed of a hydrophilic material, the first layer has the effect of sucking a liquid by capillary force.

The hydrophilic material is preferably selected from raw materials such as cellulose and polyacrylamide, and composite materials of them, for example. The surface of the water-repellent materials mentioned below can be subjected to hydrophilization treatment, and a resulting material can be used as the hydrophilic material. The hydrophilization treatment is performed by a method such as sputter etching, radiation exposure, $H_2O$ ion exposure, excimer (ultraviolet) laser beam irradiation.

In order to suppress coloring material adhesion and to improve cleanability, the material of the first layer is preferably a water-repellent material having a low surface free energy, specifically a fluororesin. The fluororesin is specifically exemplified by polytetrafluoroethylene (hereinafter PTFE), polychlorotrifluoroethylene (PCTFE), polyvinylidene fluoride (PVDF), polyvinyl fluoride (PVF), perfluoroalkoxy fluororesin (PFA), a tetrafluoroethylene/hexafluoropropylene copolymer (FEP), an ethylene/tetrafluoroethylene copolymer (ETFE), and an ethylene/chlorotrifluoroethylene copolymer (ECTFE). These resins can be used singly or in combination of two or more of them as needed. A plurality of films may be laminated in the first layer. A first layer composed of a water-repellent material has almost no function of sucking an aqueous liquid component by capillary force, and may take time to suck an aqueous liquid component when coming into contact with an image for the first time. On this account, the first layer is preferably impregnated with a liquid having a contact angle with the first layer of less than 90°. In contrast to the first liquid and an optional second liquid in the first image, the liquid that is infiltrated into the first layer is also called third liquid or wetting liquid. The third liquid can be applied onto the first surface of the liquid absorbing member to be infiltrated into the first layer. The third liquid is preferably prepared by mixing the first liquid (water) with a surfactant or a liquid having a low contact angle with the first layer.

In the present invention, the first layer preferably has a film thickness of 50 μm or less. The film thickness is more preferably 30 μm or less. In the examples, the film thickness was determined by measuring film thicknesses at any 10 points with a linear micrometer, OMV-25 (manufactured by Mitutoyo) and calculating the average.

The first layer can be produced by a known method for producing a thin porous film. For example, a resin material can be subjected to extrusion molding or a similar technique to give a sheet-like material, and the sheet-like material can be drawn into an intended thickness, yielding a first layer. Alternatively, a plasticizer such as paraffin can be added to the material for extrusion molding, and the plasticizer can be removed, for example, by heating at the time of drawing, yielding a porous film. The pore diameter can be adjusted by appropriately controlling the amount of a plasticizer added, the draw ratio, and the like.

[Second Layer]

In the present invention, the second layer is preferably a layer having breathability. Such a layer can be either a nonwoven fabric or a woven fabric of resin fibers. The second layer may be made of any material. In order to prevent the liquid absorbed by the first layer from flowing back, the material preferably has a contact angle with the first liquid equal to or lower than that of the first layer. Specifically, the material is preferably selected from raw materials such as polyolefins (including polyethylene (PE) and polypropylene (PP)), polyurethanes, polyamides such as nylon, polyesters (including polyethylene terephthalate (PET)), and polysulfone (PSF), and composite materials of them, for example. The second layer is preferably a layer having a larger pore diameter than that of the first layer.

[Third Layer]

In the present invention, the first porous body having a multilayer structure may include three or more layers. The third and subsequent layers are preferably a nonwoven fabric from the viewpoint of rigidity. As the material, a similar material to that for the second layer can be used.

[Other Materials]

The liquid absorbing member may include, in addition to the first porous body having a multilayer structure, a reinforcing member that reinforces side faces of the liquid absorbing member. The liquid absorbing member may also include a joining member that joins the longitudinal ends of a long sheet-like porous body to form a belt-like member. For example, a non-porous tape material can be used as such a material and can be placed at a position or a cycle with which images do not come into contact.

In the present invention, the first porous body preferably has a multilayer structure including a first layer constituting the first surface and a second layer supporting the first layer. For a porous body achieving even and high breathability, the first layer in the first porous body preferably has a porosity of 50% to 95%, and the second layer preferably has a porosity of 30% to 95%.

In order to suppress adhesion of the coloring material in an ink, the first layer preferably has a small pore diameter, but such pores are likely to be crushed when contact is repeated. In order to efficiency collect a liquid even at a low pressure to suppress the crush, the second surface (for example, the second layer) of the first porous body preferably has a lower compressive elastic modulus than that of the first surface (the first layer).

The compressive elastic modulus can be determined by the following procedure. A digital film thickness meter (Litematic, manufactured by Mitutoyo) is used to determine the film thickness of each porous body. Separately, a tacking tester, TAC-1000 (manufactured by RHESCA) is used, and a Φ5-mm probe is pushed into each porous body to measure the length of the probe that gets into the porous body and the pressure thereof. The compressive elastic modulus is a value calculated by dividing the stress measured by the above measurement by the distortion.

[Production Method of First Porous Body]

The method of laminating the first layer and the second layer to form the first porous body may be any method. The layers can be simply laminated or may be bonded to each other by a technique such as lamination by an adhesive agent or lamination by heating. From the viewpoint of breathability, lamination by heating is preferred in the present invention. Alternatively, the first layer or the second layer may be partly melted by heat, for example, and the layers may be adhesively laminated. A fusing material such as a hot melt powder may be interposed between the first layer and the second layer, and the layers may be adhesively laminated by heating. When a third or subsequent layer is laminated, layers may be laminated at once, or may be laminated successively. The lamination order is appropriately selected.

In the heating step, preferred is a lamination method in which porous bodies are heated while the porous bodies are interposed between heated rollers and pressed.

<Liquid Collecting Device>

The present invention includes a liquid collecting step of compressing the first porous body that has absorbed a first liquid from a first image, from a second surface opposite to the first surface by a compression member to extrude, from the first surface of the first porous body, a liquid component containing the first liquid absorbed by the first porous body, and absorbing and collecting the liquid component. In the liquid collecting step, the liquid component extruded from the first surface of the first porous body is absorbed and collected by using a liquid collecting member including a second porous body. The liquid collecting device includes a compression member for compressing the first porous body and a liquid collecting member including a second porous body.

[Compression Member]

The compression member is not limited to particular compression members, but is preferably a member having a certain structural strength from the viewpoint of durability. As the material of the compression member, metals, ceramics, resins and the like are preferably used. Specifically preferred are aluminum, iron, stainless steel, acetal resins, epoxy resins, polyimide, polyethylene, polyethylene terephthalate, nylon, polyurethane, silica ceramics, and alumina ceramics. These materials can be used in combination.

(Compressive Conditions)

The applied pressure (compressive force) by the compression member to the first porous body is preferably 2.9 N/cm$^2$ (0.3 kgf/cm$^2$) or more because the liquid component can be extruded and collected from the first surface of the first porous body in such a condition. The applied pressure in the present invention represents the nip pressure between a first porous body and a compression member, and is determined by the following procedure. A surface pressure distribution measuring device (I-SCAN manufactured by Nitta) is used to perform surface pressure measurement, and the load in a compressed region is divided by the area, giving the applied pressure.

Extrusion of the liquid component from the first porous body by the compression member is performed by pressing the compression member against the second surface of the first porous body. The compressive force when the compression member is used to collect the liquid component from the first porous body is preferably larger than the pressure (nip pressure) when the first porous body comes into contact with the first image in the liquid absorbing step. At the time of compression, an unnecessarily high compressive force should not be applied in order to prevent the first porous body from being greatly deformed not to return to the original shape. On this account, the pressure by the compression member is controlled to apply an appropriate compressive force.

(Application Time)

The application time (compression nip time) for contact of the compression member with the first porous body is preferably 2 ms or more in order to stably collect the liquid component from the first porous body. In the present invention, the application time is a value calculated by dividing the pressure detection width in a movement direction of the first porous body in the above surface pressure measurement by the movement speed of the first porous body.

[Liquid Collecting Member]

The liquid component extruded from the first porous body to the first surface by the compression member is collected on the first surface by using a liquid collecting member. In the present invention, the liquid collecting member includes a second porous body. As the second porous body, PTFE, FEP, PFA, CTFE, PVDF, EVA, PVA, EVA, PE, PP, a cross-linked product of sodium polyacrylate, a starch-polyacrylonitrile hydrolysate, and similar materials can be used. Such a material can be subjected to a process suitable for the material, such as casting, pressing, high-frequency discharging, arc discharging, drawing, irradiation etching, and thermally induced phase separating, and a resulting porous material can be used. The shape of the second porous body is exemplified by a roller shape and a belt shape.

In the present invention, when a second porous body having an excessively small hardness is deformed at the time of compression of the first porous body, the second porous body is difficult to return to the original shape. On this account, the second porous body preferably has a hardness of 20° or more, which is determined by the spring method using a durometer type D in accordance with JIS K6253. The second porous body preferably has a larger hardness than the hardness of the first porous body.

In the present invention, in order to more efficiently collect the liquid component, it is preferred that the first liquid contain water and the surface of the second porous body have a smaller contact angle with water than the contact angle with water of the first surface of the first porous body. Specifically, the first surface of the first porous body preferably has a contact angle with water of 90 to 120°, and the surface of the second porous body preferably has a contact angle with water of 20 to 89°.

In order to more efficiently collect the liquid component, the second porous body preferably has a larger liquid flow rate than the liquid flow rate of the first porous body. In the present invention, the liquid flow rate is a flow rate [ml/min/cm$^2$] per unit area (1 cm$^2$) when IPA (isopropyl alcohol) is allowed to pass at a differential pressure of 0.1 MPa.

In order to more efficiently collect the liquid component, the relation between the Gurley value G1 of the first porous body in accordance with JIS P8117 and the Gurley value G2 of the second porous body in accordance with JIS P8117 preferably satisfies the following equation.

$$0.5 \times G1 \geq G2$$

As for the position of the liquid collecting member including the second porous body relative to the liquid absorbing member including the first porous body, the second porous body is arranged at least on the side of the first porous body to come into contact with the first image, or on the first surface.

The first layer in the first porous body preferably has a small pore diameter from the viewpoint of coloring material adhesion at the time of pressure contact with the first image. Such a porous body, however, has a higher flow resistance, and thus the liquid is insufficiently collected from the first porous body in some cases. When the liquid absorbed by the first layer in the first porous body is not collected and is left in the first porous body, the liquid is dried to increase the viscosity. This may cause disorder of an image when the first porous body comes into contact with the first image. However, by arranging the second porous body at least on the first surface of the first porous body as in the present invention, the liquid can be efficiently collected from the first porous body even having a small pore diameter. In a collection system by squeezing with a nonporous roller or a blade, the liquid may insufficiently move to the roller or the blade, or the collected liquid may return to the first porous body, and the liquid cannot be rapidly collected in some cases. However, it has been revealed that by providing the second porous body as in the present invention, the liquid absorbed by the first porous body is collected by the second porous body, and thus the liquid can be collected at high speed.

As for the application operation of a compressive force in the liquid collecting step, an ON/OFF control can be intermittently performed in accordance with a predetermined schedule or may be performed by estimating the amount of a liquid component absorbed by the first porous body based on printing data. The ON/OFF control of the compressive force application operation may be performed on the bases of such a schedule or printing data as mentioned above, but more exact observation of the amount of a liquid component absorbed by the first porous body enables more efficient collection of the liquid component. Specifically, for example, a flow meter is provided in the first porous body, and the amount of a liquid component absorbed by the first porous body is estimated from the measured value. In response to the estimated result, the compressive force application operation is controlled. In this manner, the second porous body is intermittently spaced apart from the first porous body, and the liquid is infiltrated into and absorbed by the second porous body, thereby enabling more efficient collection of a large amount of the liquid.

Figure 2:
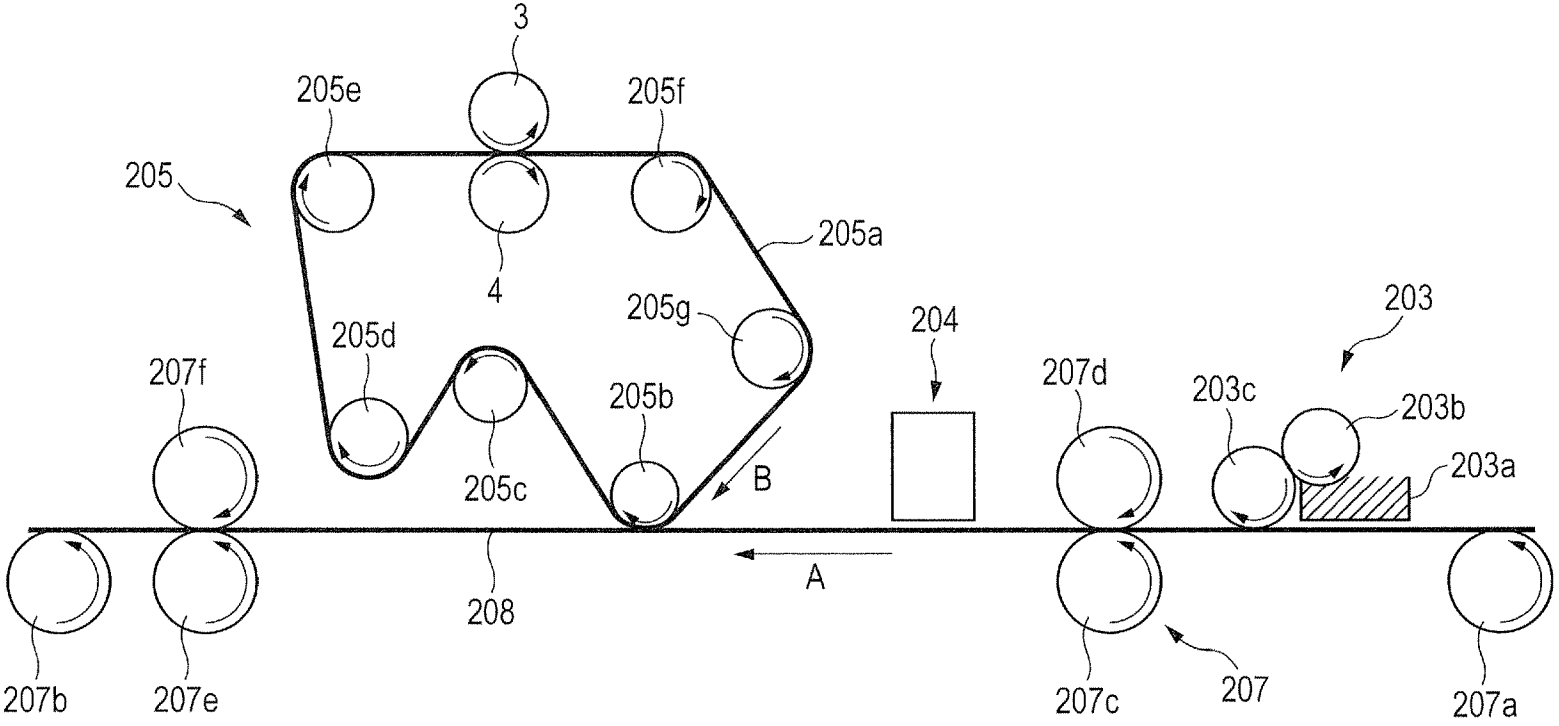
FIG. 2 is a schematic view showing an exemplary structure of a direct drawing type ink jet recording apparatus according to an embodiment of the present invention.
Figure 6A:
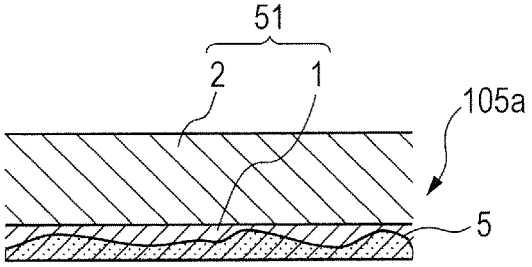
FIGS. 6A, 6B, 6C and 6D are schematic sectional views showing an exemplary liquid absorbing step and an exemplary liquid collecting step in the present invention.
Figure 6B:
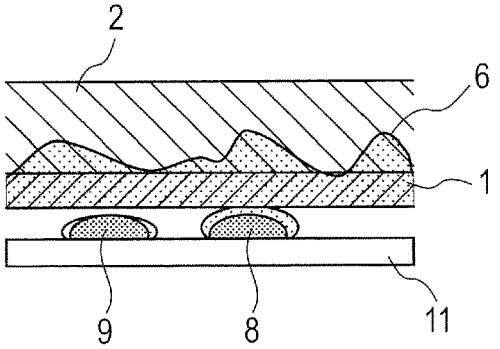
Figure 6C:
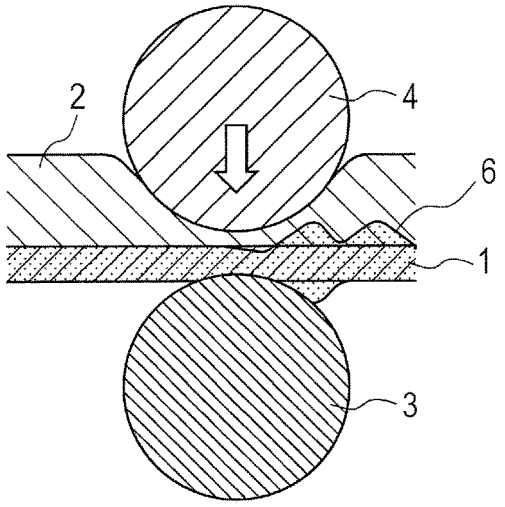
Figure 6D:
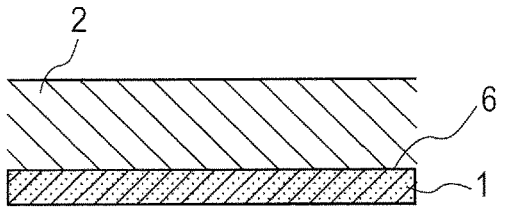

With reference to FIGS. 6A to 6D, the liquid collecting device pertaining to the present invention will be described. FIGS. 6A to 6D show an example using a first porous body 51 as a liquid absorbing member 105*a*, a liquid collecting roller 3 as a liquid collecting member, and a compression roller 4 as a compression member. In FIGS. 6A to 6D, the first porous body 51 has a two-layer structure composed of a first layer 1 and a second layer 2. By bringing the first layer 1 of the first porous body 51 into contact with a first image 8 on an ink receiving medium 11, a first liquid can be absorbed to give a second image 9 in which the liquid is reduced from the first image 8. In FIG. 6A, a wetting liquid 5 is previously infiltrated into the first porous body 51, and in FIG. 6B, a liquid component 6 is absorbed from the first image 8. Next, as shown in FIG. 6C, the compression roller 4 is placed on and pressed against the second layer 2 of the first porous body 51 to compress the second layer 2, thereby extruding the liquid component 6 to the first layer 1. The extruded liquid component 6 is absorbed and removed by the liquid collecting roller 3. The liquid collecting roller 3 and the compression roller can be arranged at positions as shown in FIG. 1 and FIG. 2, but may be arranged at any position after the liquid component is absorbed from the first image. At this time, it is sufficient to extrude the liquid component in the second layer 2. Even when the liquid component is left in the first layer 1 (FIG. 6D), liquid absorption at the time of subsequent liquid absorption is not affected on the same principle as for the wetting liquid 5.

Figure 7A:
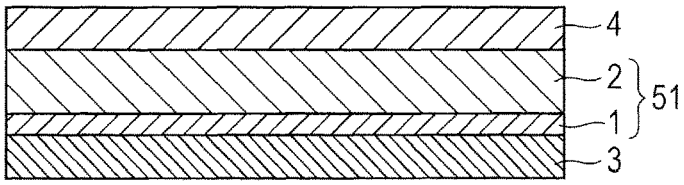
FIGS. 7A, 7B and 7C are enlarged sectional views showing arrangement examples of a liquid collecting device in the present invention.
Figure 7B:
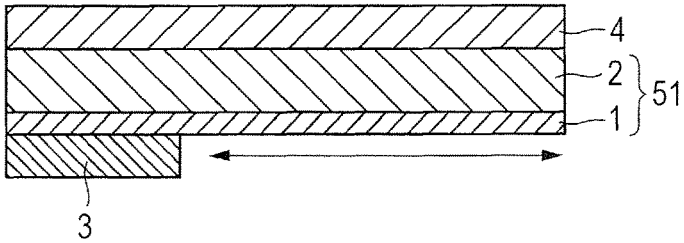
Figure 7C:
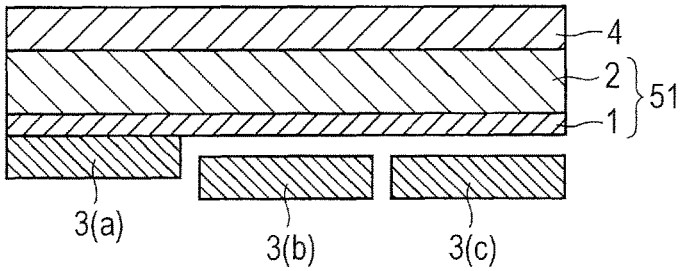

Next, with reference to FIGS. 7A to 7C, the specific structures of the first porous body 51 and the liquid collecting roller 3 will be described. FIGS. 7A to 7C are enlarged sectional views showing the structures of the first porous body 51 and the liquid collecting roller 3 in a direction perpendicular to the conveyance direction B of the liquid absorbing member 105*a*. FIG. 7A shows the structure where the liquid collecting roller 3 corresponding to the full width of the liquid absorbing member 105*a* is brought into contact with the first layer 1 of the first porous body 51. As an embodiment of the present invention, as shown in FIG. 7B, the contact position of the liquid collecting roller 3 with the first porous body 51 is movable in the roller axis direction, and even when an image is formed across the width direction of the transfer body (ink receiving medium), the liquid collecting roller 3 can be moved across the whole region in the width direction of the first porous body 51 to collect a liquid. Alternatively, the position of the liquid collecting roller 3 may be controlled in response to image data in such a manner that the liquid collecting roller 3 is moved in accordance with the position of a first image on the transfer body to intensively collect a liquid component depending on ink discharged areas. Alternatively, as shown in FIG. 7C, the liquid collecting roller 3 may be divided in the width direction of the first porous body 51 into a plurality of portions, and a portion of the liquid collecting roller 3 may be brought into contact with the first layer 1 of the first porous body 51 in accordance with the position of a first image on the transfer body (in FIG. 7C, a first liquid collecting roller 3(*a*) comes into contact but a second liquid collecting roller 3(*b*) and a third liquid collecting roller 3(*c*) do not come into contact), thereby intensively collecting the liquid component depending on ink discharged areas. The first to third liquid collecting rollers can be selected in response to image data.

Figure 8:
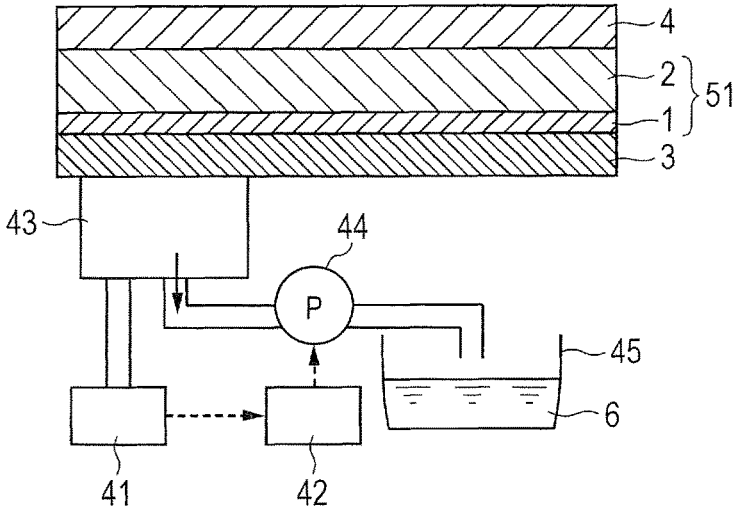
FIG. 8 is a schematic view showing a structure of removing a liquid component from a liquid collecting member of the liquid collecting device in the present invention.

In order to efficiently collect the liquid from the liquid absorbing member, the liquid collecting member preferably further includes a mechanism of removing and discharging the liquid from the liquid collecting member to the outside. In the present invention, such a mechanism as shown in FIG. 8 can be used, for example. FIG. 8 shows the structure for estimating the amount of a liquid component collected in the liquid collecting roller 3 (liquid collecting member) and removing the liquid from the liquid collecting roller 3. In order to discharge the liquid component 6 collected in the liquid collecting roller 3 into a liquid component storage tank 45 installed outside, a suction box 43 is attached to the liquid collecting roller 3, and the pressure in the suction box 43 is monitored by a pressure gauge 41. A pump control device 42 for controlling ON/OFF of a suction pump 44 connected to the suction box 43 based on the measured value by the pressure gauge 41 is further installed. For example, the amount of the liquid component collected in the liquid collecting roller 3 can be estimated from the measured pressure value by the pressure gauge 41, and the ON/OFF operation of the suction pump 44 can be controlled in response to the estimated result.

In the liquid collecting step of the present invention, all the liquid component in the first porous body is not necessarily collected when the liquid component containing the first liquid is collected from the first porous body as mentioned for FIGS. 6A to 6D. In the present invention, a small amount of the liquid component is preferably left. When a small amount of the liquid component is left in the first porous body, a liquid can be absorbed by the liquid absorbing member without pretreatment in the subsequent step of absorbing the liquid from a first image by the first porous body. In contrast, by such a method as disclosed in Japanese Patent Application Laid-Open No. 2009-61644 in which the liquid in an absorber is extruded by positive pressure with a pump and is absorbed by a sponge, all the liquid component in the absorber is removed, and thus a small amount of the liquid component cannot be left in the first porous body, unlike the present invention.

Next, a specific embodiment of the ink jet recording apparatus will be described.

The ink jet recording apparatus includes an ink jet recording apparatus in which a first image is formed on a transfer body as the ink receiving medium and a second image after absorption of a first liquid by a liquid absorbing member is transferred onto a recording medium and an ink jet recording apparatus in which a first image is formed on a recording medium as the ink receiving medium. In the present invention, the former ink jet recording apparatus is called transfer type ink jet recording apparatus for convenience hereinafter, and the latter ink jet recording apparatus is called direct drawing type ink jet recording apparatus for convenience hereinafter.

Each ink jet recording apparatus will next be described.

<Transfer Type Ink Jet Recording Apparatus>

FIG. 1 is a schematic view showing an exemplary schematic structure of a transfer type ink jet recording apparatus of the embodiment.

The transfer type ink jet recording apparatus 100 includes a transfer body 101 for temporarily holding a first image and a second image formed by absorbing and removing at least some of a first liquid from the first image. The transfer type ink jet recording apparatus 100 further includes a pressing member for transferring 106 that transfers the second image onto a recording medium 108 on which an image is to be formed.

The transfer type ink jet recording apparatus 100 of the present invention includes the transfer body 101 supported by a support member 102, a reaction liquid applying device 103 for applying a reaction liquid onto the transfer body 101, an ink applying device 104 for applying an ink onto the transfer body 101 with the reaction liquid to form an ink image (first image) on the transfer body, a liquid absorbing device 105 for absorbing a liquid component from the first image on the transfer body, and the pressing member 106 for pressing a recording medium to transfer a second image from which the liquid component has been removed, on the transfer body onto the recording medium 108 such as paper. The transfer type ink jet recording apparatus 100 may further include a cleaning member 109 for a transfer body for cleaning the surface of the transfer body 101 after transfer of the second image onto the recording medium 108.

The support member 102 rotates around a rotating shaft 102*a* as the center in the arrow direction A in FIG. 1. By rotating the support member 102, the transfer body 101 moves. On the moving transfer body 101, a reaction liquid and an ink are sequentially applied by the reaction liquid applying device 103 and the ink applying device 104, respectively, and a first image is formed on the transfer body 101. As the transfer body 101 moves, the first image formed on the transfer body 101 moves to the position at which a liquid absorbing member 105*a* of the liquid absorbing device 105 comes into contact.

The liquid absorbing member 105*a* of the liquid absorbing device 105 synchronizes with the rotation of the transfer body 101. The first image formed on the transfer body 101 undergoes the state of contact with the moving liquid absorbing member 105*a*. During the contact state, the liquid absorbing member 105*a* removes a liquid component from the first image. By subjecting the first image to the state of contact with the liquid absorbing member 105*a*, the liquid component contained in the first image is removed. In the state of contact, the liquid absorbing member 105*a* is preferably in pressure contact with the first image at a certain pressing force for helping the liquid absorbing member 105*a* to function effectively.

The removal of the liquid component can be expressed from a different point of view as concentrating the ink constituting the first image formed on the transfer body. Concentrating the ink means that the proportion of the solid content contained in the ink, such as coloring material and resin, with respect to the liquid component contained in the ink increases owing to reduction in the liquid component.

As the transfer body 101 moves, the second image after removal of the liquid component from the first image moves to a transfer unit at which the second image comes into contact with a recording medium 108 conveyed by a recording medium conveyance device 107. While the second image from which the liquid component has been removed is in contact with the recording medium 108, pressure contact of the pressing member 106 with the recording medium 108 allows the ink image to be transferred onto the recording medium 108. The ink image after transfer onto the recording medium 108 is a reverse image of the second image. In the following description, the ink image after transfer is also called third image, separately from the first image (ink image before liquid removal) and the second image (ink image after liquid removal) described above.

On the transfer body, the reaction liquid is applied, and then the ink is applied to form the first image. Thus, the reaction liquid is not reacted with the ink and is left in a non-image region (no ink image formation region). In the apparatus, the liquid absorbing member 105*a* comes into contact with not only the first image but also the unreacted reaction liquid and removes also a liquid component in the reaction liquid from the surface of the transfer body 101.

Although the above description expresses that the liquid component is removed from the first image, the expression is not limited to removal of the liquid component only from the first image, but means that the liquid component is removed at least from the first image on the transfer body. For example, the liquid component in the reaction liquid applied to a region outside the first image can be removed together from the first image.

The liquid component may be any liquid component that does not have a certain shape and have flowability and a substantially constant volume. The liquid component is exemplified by water and an organic solvent contained in an ink or a reaction liquid.

Even when the clear ink is contained in a first image, the ink can be concentrated by the liquid absorption treatment. For example, when a clear ink is applied onto a color ink containing a coloring material applied onto the transfer body 101, the clear ink is present on the whole surface of the first image, or the clear ink is partly present at a position or a plurality positions on the surface of the first image and the color ink is present at the other positions. At the positions at which the clear ink is present on the color ink in the first image, the porous body absorbs the liquid component in the clear ink on the surface of the first image, and the liquid component in the clear ink moves. Accordingly, the liquid component in the color ink moves to the porous body, and the aqueous liquid component in the color ink is absorbed. Meanwhile, in the area in which clear ink regions and color ink regions are present on the surface of the first image, the respective liquid components of the color ink and the clear ink move to the porous body, and the aqueous liquid components are absorbed. The clear ink may contain a large amount of a component for improving the transferability of an image from the transfer body 101 to a recording medium. For example, the proportion of a component having such a stickiness to a recording medium as to be increased by heat as compared with a color ink can be increased.

Components constituting the transfer type ink jet recording apparatus of the embodiment will next be described.

(Transfer Body)

The transfer body 101 includes a surface layer having an image formation surface. As the member for the surface layer, various materials such as resins and ceramics can be appropriately used, but a material having a high compressive elastic modulus is preferred from the viewpoint of durability and the like. Specifically exemplified are an acrylic resin, an acrylic silicone resin, a fluorine-containing resin, and a condensate prepared by condensation of a hydrolyzable organic silicon compound. In order to improve the wettability of a reaction liquid, transferability, and the like, surface treatment may be performed. The surface treatment is exemplified by flame treatment, corona treatment, plasma treatment, polishing treatment, roughening treatment, active energy ray-irradiation treatment, ozone treatment, surfactant treatment, and silane coupling treatment. These treatments may be performed in combination. Any surface shape may be provided on the surface layer.

The transfer body preferably includes a compressible layer having such a function as to absorb pressure fluctuations. A provided compressible layer absorbs deformation to disperse local pressure fluctuations, and satisfactory transferability can be maintained even during high speed printing. The member for the compressible layer is exemplified by acrylonitrile-butadiene rubber, acrylic rubber, chloroprene rubber, urethane rubber, and silicone rubber. It is preferred that when such a rubber material is molded, predetermined amounts of a vulcanizing agent, a vulcanization accelerator, and the like be added, and a foaming agent, hollow microparticles, or a filler such as sodium chloride be further added as needed to form a porous material. In such a porous compressible layer, bubble portions are compressed with volume changes against various pressure fluctuations, thus deformation except in a compression direction is small, and more stable transferability and durability can be achieved. The porous rubber material includes a material having a continuous pore structure in which pores are connected to each other and a material having a closed pore structure in which pores are independent of each other. In the present invention, either of the structures may be used, or the structures may be used in combination.

The transfer body preferably further includes an elastic layer between the surface layer and the compressible layer. As the member for the elastic layer, various materials such as resins and ceramics can be appropriately used. From the viewpoint of processing characteristics and the like, various elastomer materials and rubber materials are preferably used. Specific examples include fluorosilicone rubber, phenylsilicone rubber, fluororubber, chloroprene rubber, urethane rubber, nitrile rubber, ethylene-propylene rubber, natural rubber, styrene rubber, isoprene rubber, butadiene rubber, ethylene/propylene/butadiene copolymers, and nitrile-butadiene rubber. Specifically, silicone rubber, fluorosilicone rubber, and phenylsilicone rubber, which have a small compress set, are preferred from the viewpoint of dimensional stability and durability. The temperature change in elastic modulus of such a material is small, and thus the above materials are preferred from the viewpoint of transferability.

Between the layers constituting the transfer body (the surface layer, the elastic layer, and the compressible layer), various adhesives or double-sided adhesive tapes may be interposed in order to fix/hold the layers. The transfer body may also include a reinforcing layer having a high compressive elastic modulus in order to suppress lateral elongation when installed in an apparatus or to maintain resilience. A woven fabric may be used as the reinforcing layer. The transfer body can be prepared by combination of any layers made from the above materials.

The size of the transfer body can be freely selected depending on the size of an intended print image. The shape of the transfer body may be any shape and is specifically exemplified by a sheet shape, a roller shape, a belt shape, and an endless web shape.

(Support Member)

The transfer body 101 is supported on a support member 102. As the supporting manner of the transfer body, various adhesives or double-sided adhesive tapes may be used. Alternatively, by attaching an installing member made from a metal, ceramics, a resin, or the like to the transfer body, the transfer body may be supported on the support member 102 by using the installing member.

The support member 102 is required to have a certain structural strength from the viewpoint of conveyance accuracy and durability. As the material for the support member, metals, ceramics, resins, and the like are preferably used. Specifically, aluminum, iron, stainless steel, acetal resins, epoxy resins, polyimide, polyethylene, polyethylene terephthalate, nylon, polyurethane, silica ceramics, and alumina ceramics are preferably used in terms of the rigidity capable of withstanding the pressure at the time of transfer, dimensional accuracy, and reduction of the inertia during operation to improve the control responsivity. It is also preferred to use these materials in combination.

(Reaction Liquid Applying Device)

The ink jet recording apparatus of the embodiment includes a reaction liquid applying device 103 for applying a reaction liquid onto the transfer body 101. The reaction liquid applying device 103 in FIG. 1 shows the case of a gravure offset roller including a reaction liquid storage unit 103*a* for storing a reaction liquid and reaction liquid applying members 103*b*, 103*c* for applying the reaction liquid in the reaction liquid storage unit 103*a* onto the transfer body 101.

(Ink Applying Device)

The ink jet recording apparatus of the embodiment includes an ink applying device 104 for applying an ink onto the transfer body 101 onto which the reaction liquid has been applied. The reaction liquid and the ink are mixed to form a first image, and a liquid component is absorbed from the first image by the subsequent liquid absorbing device 105.

(Liquid Absorbing Device)

In the present embodiment, the liquid absorbing device 105 includes a liquid absorbing member 105*a* and a pressing member 105*b* for liquid absorption for pressing the liquid absorbing member 105*a* against a first image on the transfer body 101. The liquid absorbing member 105*a* and the pressing member 105*b* may have any shape. Such a configuration as shown in FIG. 1 is exemplified. In the configuration, the pressing member 105*b* has a column shape, the liquid absorbing member 105*a* has a belt shape, and the column-like pressing member 105*b* presses the belt-like liquid absorbing member 105*a* against the transfer body 101. In another exemplified configuration, the pressing member 105*b* has a column shape, the liquid absorbing member 105*a* has a hollow column shape formed on the peripheral surface of the pressing member 105*b*, and the column-like pressing member 105*b* presses the hollow column-like liquid absorbing member 105*a* against the transfer body.

In the present invention, the liquid absorbing member 105*a* preferably has a belt shape in consideration of the space in the ink jet recording apparatus, for example.

The liquid absorbing device 105 including such a belt-like liquid absorbing member 105*a* may also include extending members for extending the liquid absorbing member 105*a*. In FIGS. 1, 105*c*, 105*d*, and 105*e* are extending rollers as the extending members. In FIG. 1, the pressing member 105*b* is also a roller member rotating as with the extending rollers, but is not limited to this.

In the liquid absorbing device 105, the liquid absorbing member 105*a* including a first porous body is pressed by the pressing member 105*b* against a first image to allow the liquid absorbing member 105*a* to absorb a liquid component contained in the first image, thereby reducing the liquid component from the first image to give a second image. As the method of reducing the liquid component in the first image, the present system of pressing the liquid absorbing member may be combined with other various techniques conventionally used, such as a heating method, a method of blowing air with low humidity, and a decompression method. Such a method may be applied to a second image containing a smaller amount of the liquid component to further reduce the liquid component. The liquid absorbing member forms a second image obtained by absorbing at least some of the first liquid from the first image on the recording medium.

Various conditions and components of the liquid absorbing device 105 will next be described in detail.

(Pretreatment)

In the present embodiment, before the liquid absorbing member 105*a* including the first porous body is brought into contact with a first image, pretreatment may be performed with a pretreatment device to apply a wetting liquid to the liquid absorbing member (not shown in FIGS. 1 and 2). The wetting liquid preferably contains water and a water-soluble organic solvent. The water is preferably a deionized water prepared by ion exchanging, for example. The water-soluble organic solvent is not limited to particular types, and any known organic solvent such as ethanol and isopropyl alcohol can be used. In the pretreatment of the liquid absorbing member, the method of applying the wetting liquid may be any method, but immersing or liquid dropping is preferred.

(Pressing Conditions)

The pressure of the liquid absorbing member pressing against a first image on the transfer body is preferably 2.9 $N/cm^2$ (0.3 $kgf/cm^2$) or more because the liquid in the first image can be separated by solid-liquid separation for a shorter time and the liquid component can be removed from the first image. The pressure of a liquid absorbing member in the present specification represents the nip pressure between an ink receiving medium and a liquid absorbing member, and is the value determined by the following procedure. A surface pressure distribution measuring device (I-SCAN manufactured by Nitta) is used to perform surface pressure measurement, and the load in a pressed region is divided by the area, giving the pressure.

(Application Time)

The application time for contact of the liquid absorbing member 105*a* with a first image is preferably within 50 ms (milliseconds) in order to further suppress adhesion of the coloring material in the first image to the liquid absorbing member. In the present specification, the application time is calculated by dividing the pressure detection width in a movement direction of the ink receiving medium in the above surface pressure measurement by the movement speed of the ink receiving medium. Hereinafter, the application time is called liquid absorbing nip time.

In this manner, a second image in which the liquid component is absorbed from the first image to reduce the liquid component is formed on the transfer body 101. The second image is transferred onto a recording medium 108 by the subsequent transfer unit. The device configuration and conditions for transfer will be described.

(Pressing Member for Transferring)

In the present embodiment, during contact of the second image with a recording medium 108 conveyed by a recording medium conveyance device 107, a pressing member for transferring 106 presses the recording medium 108, thereby transferring the image (ink image) onto the recording medium 108. The liquid component contained in the first image on the transfer body 101 is removed, then the image is transferred onto the recording medium 108, and consequently a recorded image prevented from causing curing, cockling, and the like can be produced.

The pressing member 106 is required to have a certain structural strength from the viewpoint of the conveyance accuracy of a recording medium 108 and durability. As the material for the pressing member 106, metals, ceramics, resins, and the like are preferably used. Specifically, aluminum, iron, stainless steel, acetal resins, epoxy resins, polyimide, polyethylene, polyethylene terephthalate, nylon, polyurethane, silica ceramics, and alumina ceramics are preferably used in terms of the rigidity capable of withstanding the pressure at the time of transfer, dimensional accuracy, and reduction of the inertia during operation to improve the control responsivity. These materials may be used in combination.

The pressing time of the pressing member 106 for transferring a second image on the transfer body 101 to a recording medium 108 is not limited to particular values, but is preferably 5 ms or more to 100 ms or less in order to satisfactory transfer the image and not to deteriorate the durability of the transfer body. The pressing time in the embodiment represents the time during the contact of a recording medium 108 with a transfer body 101 and is the value determined by the following procedure. A surface pressure distribution measuring device (I-SCAN manufactured by Nitta) is used to perform surface pressure measurement, and the length in the conveyance direction of a pressured area is divided by the conveyance speed, giving the pressing time.

The pressure by the pressing member 106 for transferring a second image on the transfer body 101 to a recording medium 108 is not limited to particular values, but is controlled so as to satisfactory transfer the image and not to deteriorate the durability of the transfer body. Thus, the pressure is preferably 9.8 $N/cm^2$ (1 $kgf/cm^2$) or more to 294.2 $N/cm^2$ (30 $kgf/cm^2$) or less. The pressure in the embodiment represents the nip pressure between a recording medium 108 and a transfer body 101, and is a value determined by the following procedure. A surface pressure distribution measuring device is used to perform surface pressure measurement, and the load in a pressed region is divided by the area, giving the pressure.

The temperature during pressing by the pressing member 106 for transferring a second image on the transfer body 101 to a recording medium 108 is also not limited to particular values, but is preferably not lower than the glass transition point or not lower than the softening point of the resin component contained in an ink. A preferred embodiment for heating includes a heating device for heating a second image on the transfer body 101, the transfer body 101, and a recording medium 108.

The shape of the pressing member 106 is not limited to particular shapes, but is exemplified by a roller shape.

(Recording Medium and Recording Medium Conveyance Device)

In the present embodiment, the recording medium 108 is not limited to particular media, and any known recording medium can be used. The recording medium is exemplified by long media rolled into a roll and sheet media cut into a certain size. The material is exemplified by paper, plastic films, wooded boards, corrugated cardboard, and metal films.

In FIG. 1, the recording medium conveyance device 107 for conveying the recording medium 108 is composed of a recording medium delivery roller 107*a* and a recording medium winding roller 107*b*, but may be composed of any members capable of conveying a recording medium, and is not specifically limited to the structure.

(Control System)

Figure 3:
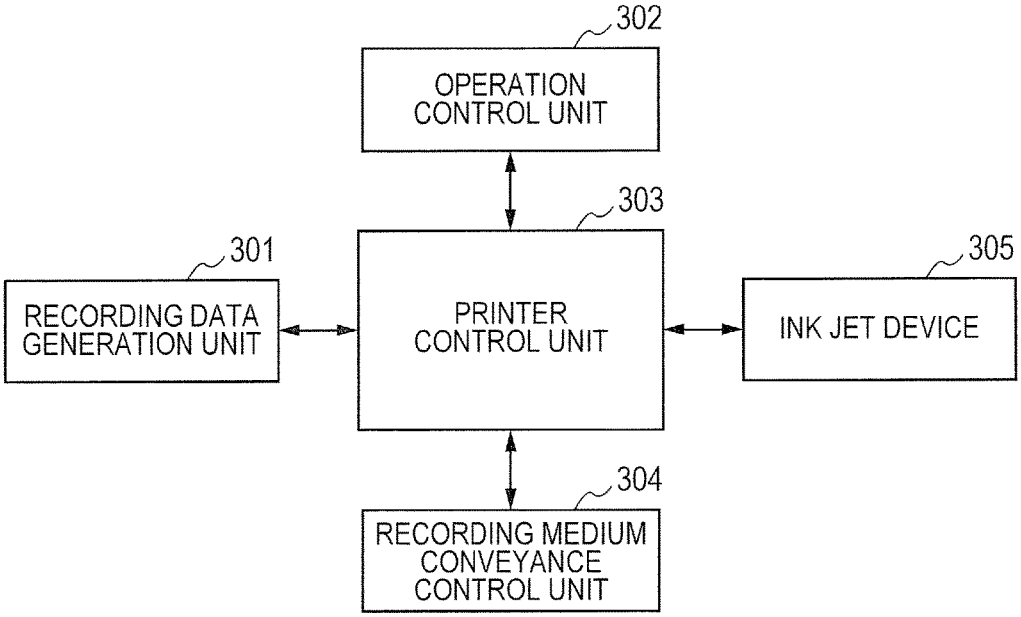
FIG. 3 is a block diagram of a control system for the whole ink jet recording apparatuses shown in FIGS. 1 and 2.

The transfer type ink jet recording apparatus in the embodiment has a control system for controlling each device. FIG. 3 is a block diagram of a control system for the whole transfer type ink jet recording apparatus shown in FIG. 1.

In FIG. 3, 301 is a recording data generation unit such as an external print server, 302 is an operation control unit such as an operation panel, 303 is a printer control unit for executing a recording process, 304 is a recording medium conveyance control unit for conveying a recording medium, and 305 is an ink jet device for printing.

Figure 4:
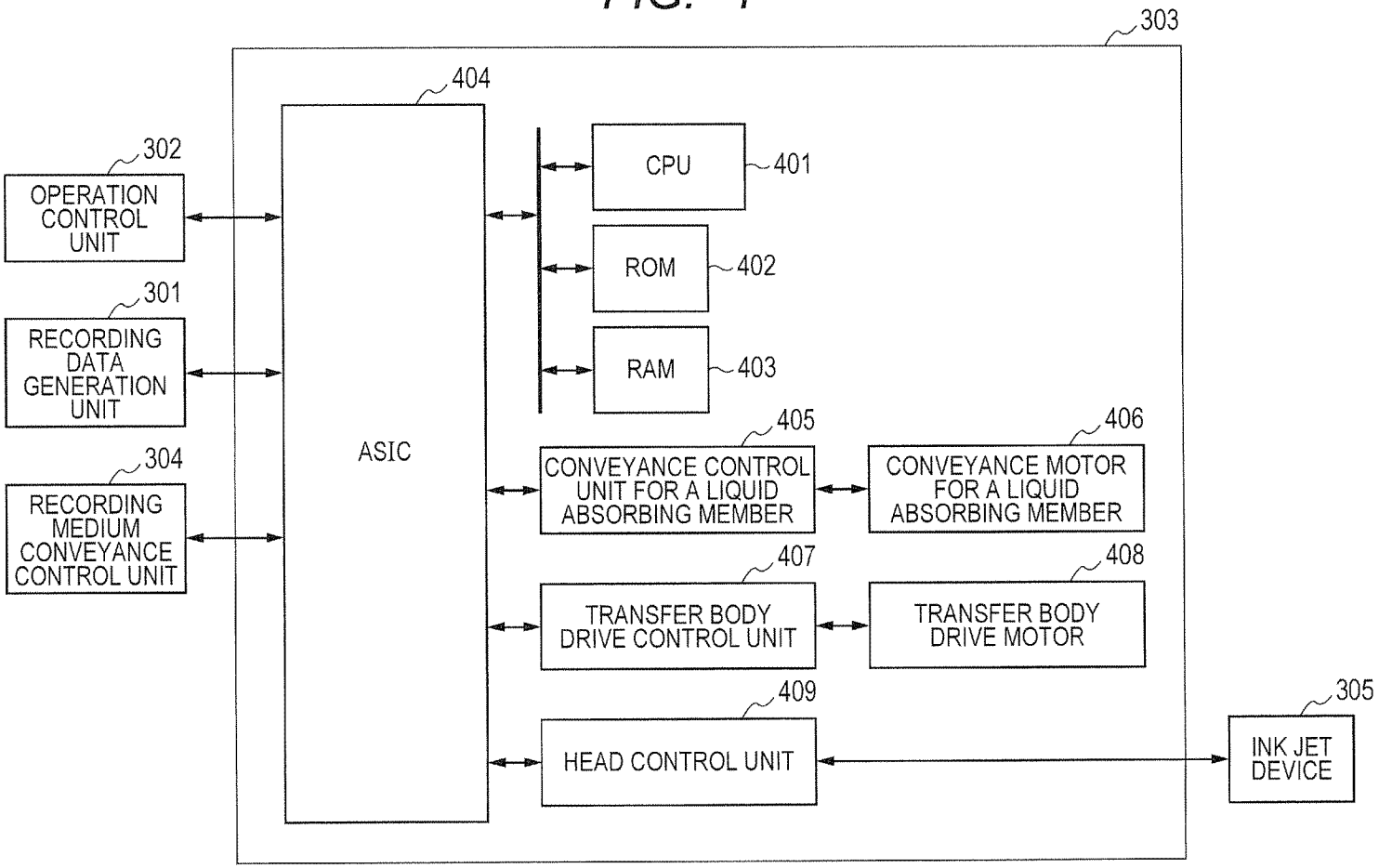
FIG. 4 is a block diagram of a printer control unit in the transfer type ink jet recording apparatus shown in FIG. 1.

FIG. 4 is a block diagram of the printer control unit in the transfer type ink jet recording apparatus in FIG. 1.

401 is a CPU for controlling the whole printer, 402 is a ROM for storing a control program for the CPU, and 403 is a RAM for executing a program. 404 is an application specific integrated circuit (ASIC) including a network controller, a serial IF controller, a controller for generating head data, a motor controller, and the like. 405 is a conveyance control unit for a liquid absorbing member for driving a conveyance motor 406 for a liquid absorbing member and is controlled by a command from the ASIC 404 via a serial IF. 407 is a transfer body drive control unit for driving a transfer body drive motor 408 and is also controlled by a command from the ASIC 404 via a serial IF. 409 is a head control unit and performs final discharge data generation for the ink jet device 305 and drive voltage generation, for example.

<Direct Drawing Type Ink Jet Recording Apparatus>

As another embodiment of the present invention, a direct drawing type ink jet recording apparatus is exemplified. In the direct drawing type ink jet recording apparatus, the ink receiving medium is a recording medium on which an image is to be formed.

FIG. 2 is a schematic view showing an exemplary schematic structure of a direct drawing type ink jet recording apparatus 200 in the embodiment. As compared with the above transfer type ink jet recording apparatus, the direct drawing type ink jet recording apparatus includes the same members as the transfer type ink jet recording apparatus except that the transfer body 101, the support member 102, and the cleaning member 109 for a transfer body are not included, and an image is formed on a recording medium 208.

Hence, a reaction liquid applying device 203 for applying a reaction liquid onto the recording medium 208, an ink applying device 204 for applying an ink onto the recording medium 208, and a liquid absorbing device 205 including a liquid absorbing member 205*a* that comes into contact with a first image on the recording medium 208 to absorb a liquid component contained in the first image have the same structures as those in the transfer type ink jet recording apparatus, and are not described.

In the direct drawing type ink jet recording apparatus of the embodiment, the liquid absorbing device 205 includes the liquid absorbing member 205*a* and a pressing member 205*b* for liquid absorption that presses the liquid absorbing member 205*a* against the first image on the recording medium 208. The liquid absorbing member 205*a* and the pressing member 205*b* may have any shape, and members having substantially the same shapes as those of the liquid absorbing member and the pressing member usable in the transfer type ink jet recording apparatus can be used. The liquid absorbing device 205 may further include extending members for extending the liquid absorbing member. In FIGS. 2, 205*c*, 205*d*, 205*e*, 205*f*, and 205*g* are extending rollers as the extending members. The number of extending rollers is not limited to 5 as shown in FIG. 4, and an intended number of rollers can be arranged depending on the design of an apparatus. The direct drawing type ink jet recording apparatus may further include recording medium support members, not shown in the drawings, for supporting the recording medium from below, at a position opposed to an ink applying unit including the ink applying device 204 for applying an ink to the recording medium 208 and a position opposed to a liquid component removing unit including the liquid absorbing member 205*a* that comes into pressure contact with a first image on the recording medium to remove a liquid component.

(Recording Medium Conveyance Device)

In the direct drawing type ink jet recording apparatus of the embodiment, a recording medium conveyance device 207 is not limited to particular devices, and a conveyance device in a known direct drawing type ink jet recording apparatus can be used. As shown in FIG. 2, a recording medium conveyance device including a recording medium delivery roller 207*a*, a recording medium winding roller 207*b*, and recording medium conveyor rollers 207*c*, 207*d*, 207*e*, and 207*f* is exemplified.

(Control System)

The direct drawing type ink jet recording apparatus in the embodiment has a control system for controlling each device. A block diagram of the control system for the whole direct drawing type ink jet recording apparatus shown in FIG. 2 is as shown in FIG. 3 as with the transfer type ink jet recording apparatus shown in FIG. 1.

Figure 5:
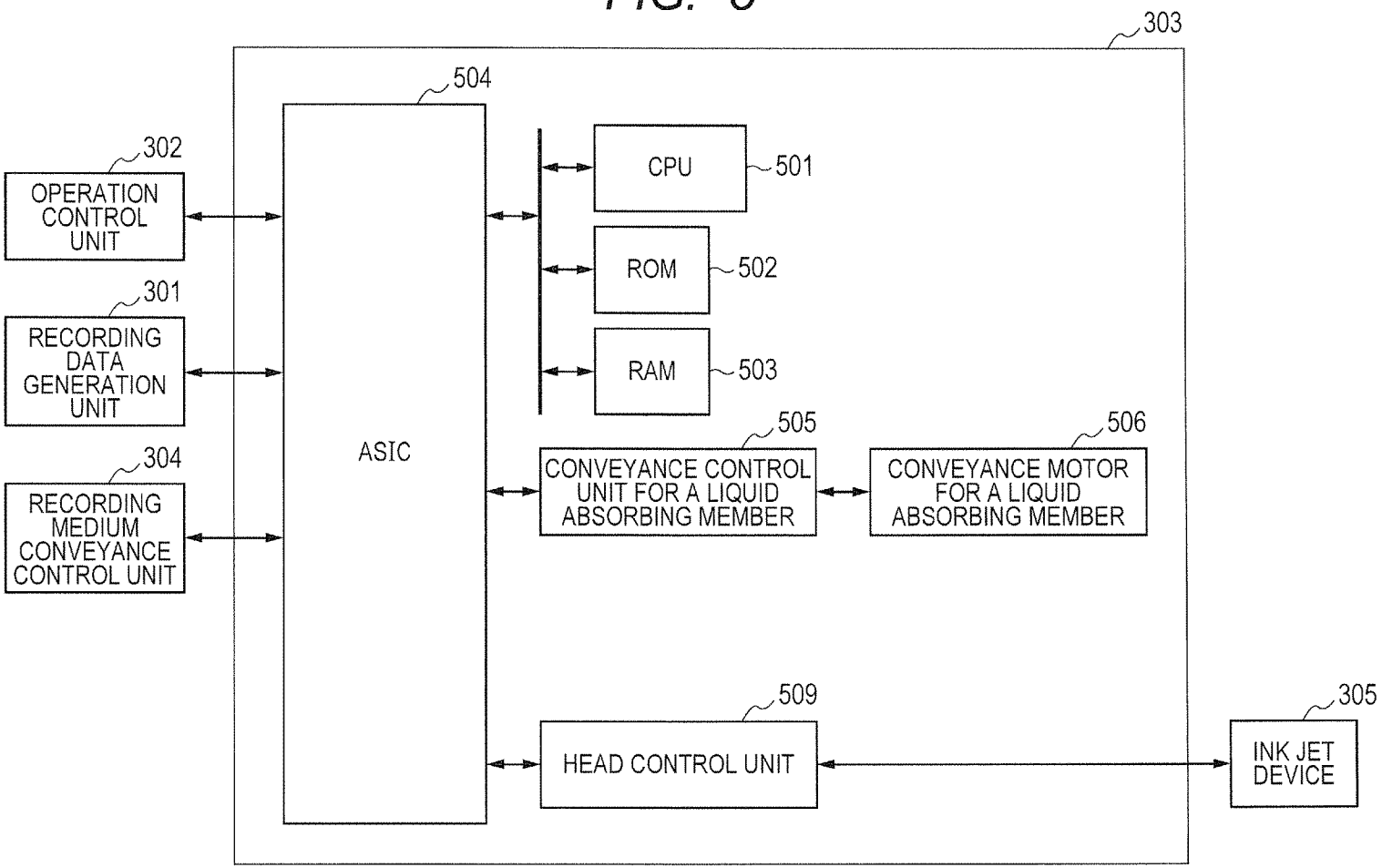
FIG. 5 is a block diagram of a printer control unit in the direct drawing type ink jet recording apparatus shown in FIG. 2.

FIG. 5 is a block diagram of the printer control unit in the direct drawing type ink jet recording apparatus in FIG. 2. The block diagram is the same as the block diagram of the printer control unit in the transfer type ink jet recording apparatus in FIG. 4 except that the transfer body drive control unit 407 and the transfer body drive motor 408 are not included.

In other words, 501 is a CPU for controlling the whole printer, 502 is a ROM for storing a control program for the CPU, and 503 is a RAM for executing a program. 504 is an ASIC including a network controller, a serial IF controller, a controller for generating head data, a motor controller, and the like. 505 is a conveyance control unit for a liquid absorbing member for driving a conveyance motor 506 for a liquid absorbing member and is controlled by a command from the ASIC 504 via a serial IF. 509 is a head control unit and performs final discharge data generation for the ink jet device 305 and drive voltage generation, for example.

EXAMPLES

The present invention will next be described in further detail with reference to examples and comparative examples. The present invention is not intended to be limited to the following examples without departing from the scope of the invention. In the following description in examples, "part" is based on mass unless otherwise noted.

Example 1

<Preparation of Reaction Liquid>

As the reaction liquid to be applied by a reaction liquid applying device 103, the reaction liquid having the following formulation was used. The "remainder" of ion-exchanged water is such an amount that the total amount of all the components constituting the reaction liquid will be 100.0% by mass (the same applies hereinafter).

Glutaric acid 21.0% by mass

Glycerol 5.0% by mass

Surfactant (trade name: MEGAFACE F-444, manufactured by DIC) 5.0% by mass

Ion-exchanged water remainder

<Preparation of Pigment Dispersion>

First, 10 parts of carbon black (trade name: Monarch 1100, manufactured by Cabot), 15 parts of a resin aqueous solution (prepared by neutralizing a 20.0% by mass aqueous solution of styrene-ethyl acrylate-acrylic acid copolymer having an acid value of 150 and a weight average molecular weight (Mw) of 8,000 with an aqueous potassium hydroxide), and 75 parts of pure water were mixed. The mixture was placed in a batch type vertical sand mill (manufactured by Aimex), and 200 parts of 0.3-mm zirconia beads were added. The mixture was dispersed for 5 hours while cooled with water. The dispersion liquid was centrifuged to remove coarse particles, giving a black pigment dispersion having a pigment content of 10.0% by mass.

<Preparation of Resin Microparticle Dispersion>

First, 20 parts of ethyl methacrylate, 3 parts of 2,2'-azobis-(2-methylbutyronitrile), and 2 parts of n-hexadecane were mixed, and the mixture was stirred for 0.5 hour. The mixture was added dropwise to 75 parts of 8% by mass aqueous solution of styrene-butyl acrylate-acrylic acid copolymer (acid value: 130 mg KOH/g, weight average molecular weight (Mw): 7,000), and the whole was stirred for 0.5 hour. Next, the mixture was sonicated with a sonicator for 3 hours. Subsequently, the mixture was polymerized under a nitrogen atmosphere at 80° C. for 4 hours. The reaction mixture was cooled to room temperature and then filtered, giving a resin microparticle dispersion having a resin content of 25.0% by mass.

<Preparation of Ink>

The black pigment dispersion and the resin microparticle dispersion were mixed with the components shown below.

Pigment dispersion (a coloring material content of 10.0% by mass) 40.0% by mass

Resin microparticle dispersion 20.0% by mass

Glycerol 7.0% by mass

Polyethylene glycol (number average molecular weight (Mn): 1,000) 3.0% by mass

Surfactant (trade name: Acetylenol E100, manufactured by Kawaken Fine Chemicals) 0.5% by mass Ion-exchanged water remainder The components were thoroughly stirred and dispersed and then subjected to pressure filtration through a microfilter with a pore size of 3.0 μm (manufactured by Fujifilm), giving a black ink.

<Ink Jet Recording Apparatus and Image Formation>

The transfer type ink jet recording apparatus shown in FIG. 1 was used. The transfer body 101 is fixed to the support member 102 with a double-sided adhesive tape. A PET sheet having a thickness of 0.5 mm was coated with a silicone rubber (trade name: KE12, manufactured by Shin-Etsu Chemical) into a thickness of 0.3 mm, and the resulting sheet was used as the elastic layer of the transfer body 101. Glycidoxypropyltriethoxysilane and methyltriethoxysilane were mixed at a molar ratio of 1:1, and the mixture was heated and refluxed to give a condensate. The condensate was mixed with a photocationic polymerization initiator (trade name: SP150, manufactured by ADEKA) to give a mixture. Atmospheric pressure plasma treatment was performed so that the elastic layer surface would have a contact angle with water of 10° or less. Then, the above mixture was applied onto the elastic layer and subjected to UV irradiation (with a high-pressure mercury lamp, an integrated exposure amount of 5,000 mJ/cm$^2$) and to thermal curing (150° C., 2 hours) to form a film, yielding a transfer body 101 including the elastic layer on which a surface layer having a thickness of 0.5 μm was formed. The surface of the transfer body 101 was maintained at 60° C. by a heater (not shown in the drawings).

The amount of the reaction liquid applied by the reaction liquid applying device 103 was 1 g/m$^2$. As the ink applying device 104, an ink jet recording head including an electrothermal converter for discharging an ink on demand was used. The amount of the ink applied to form an image was 20 g/m$^2$.

The conveyance speed of the liquid absorbing member 105*a* was adjusted by conveyor rollers 105*c*, 105*d*, and 105*e*, which conveyed the liquid absorbing member while extending the liquid absorbing member, so as to be substantially the same speed as the movement speed of the transfer body 101. The recording medium 108 was conveyed by the recording medium delivery roller 107*a* and the recording medium winding roller 107*b* so as to be substantially the same speed as the movement speed of the transfer body 101. The conveyance speed of the recording medium 108 was 0.2 m/s. As the recording medium 108, Aurora Coat Paper (manufactured by Nippon Paper Industries, a basis weight of 104 g/m$^2$) was used.

Next, the liquid removal method and the liquid component collection method in the example will be described with reference to FIGS. 6A to 6D. As the liquid absorbing member 105*a*, a first porous body 51 composed of two layers of a first layer 1 and a second layer 2 was used. As the liquid absorbing member, a belt-like member was used. By bringing the first layer 1 of the first porous body 51 into contact with a first image 8, a liquid component 6 in the ink can be absorbed and the liquid can be reduced from the first image 8. As the first layer 1, a drawn film made from PTFE and having a pore diameter of 0.2 μm and a thickness of 10 μm was used. As the second layer 2, a nonwoven fabric made from a PET material and having a pore diameter of 20 μm and a thickness of 190 μm was used. The first layer and the second layer were integrated by heat pressure lamination, and the laminate was used as the first porous body 51. The first porous body 51 had a flow rate per unit area (1 cm$^2$) of 3 ml/min/cm$^2$ that was determined by passing IPA (isopropyl alcohol) at a differential pressure of 0.1 MPa. The first porous body 51 had a Gurley value G1 of 8 s in accordance with JIS P8117. Table 1 collectively shows the structures and physical properties of the first porous body 51. In the example, the first porous body having the structure (a) was used. As a pretreatment, the first porous body 51 was immersed in a wetting liquid composed of 95 parts of ethanol and 5 parts of water to be impregnated with the wetting liquid, and the wetting liquid was replaced with water. The resulting first porous body was used for liquid absorption from first images.

TABLE 1

| | First porous body | | | | | | | |
|---|---|---|---|---|---|---|---|---|
| | Structure (a) | | | | Structure (b) | | | |
| | Material | Thickness | Porosity | Compressive elastic modulus | Material | Thickness | Porosity | Compressive elastic modulus |
| First layer | PTFE | 10 μm | 80% | 1.8 MPa | PTFE | 10 μm | 80% | 1.5 MPa |
| Second layer | PET | 190 μm | 85% | 0.8 MPa | PET | 150 μm | 75% | 1.6 MPa |
| Porous body after integration by heat pressure lamination | Liquid flow rate: 3[ml/min/cm$^2$] Gurley value G1: 8 s Contact angle with water of first layer: 115° | | | 0.8 MPa | Liquid flow rate: 4[ml/min/cm$^2$] Gurley value G1: 8 s Contact angle with water of first layer: 116° | | | 1.6 MPa |

A liquid collecting roller 3 was arranged on the first layer 1 of the first porous body 51. Specifically, in the example, the conformation of the first porous body 51 and the liquid collecting roller 3 was as shown in FIG. 7A. Then, a compression roller 4 compressed the first porous body 51 from the second layer 2 (second surface) to extrude the liquid component 6 to the first layer 1, and the liquid component 6 was absorbed and collected by the liquid collecting roller 3. As the liquid collecting roller 3, an EVA (ethyl vinyl acetate) porous body (second porous body), an elastic body having a hardness of 60, was used. The liquid collecting roller 3 had a contact angle with water of 45° and a Gurley value G2 of 2 s in accordance with JIS P8117. The flow rate per unit area (1 $cm^2$) was 30 ml/min/$cm^2$, which was determined by passing IPA (isopropyl alcohol) at a differential pressure of 0.1 MPa. The compression roller 4 was a metal roller. In the liquid collecting step, the compressive force was 29.4 N/$cm^2$ (3.0 kgf/$cm^2$) and the compression nip time was 10 ms (the conveyance speed was 500 mm/s).

The liquid collecting roller 3 has sufficiently large liquid absorbability, and thus even when these steps are repeated and the liquid collecting roller 3 contains a collected liquid, a liquid component is transferred to and collected by the liquid collecting roller 3. Not shown in the drawings, the compressive force may be released in accordance with a predetermined schedule, and the liquid component collected in the liquid collecting roller 3 may be sucked and collected by the mechanism shown in FIG. 8.

To the liquid collecting roller 3, a mechanism of removing and discharging the liquid from the liquid collecting roller 3 to the outside was further provided. In the example, the mechanism shown in FIG. 8 was used. To discharge the liquid collected in the liquid collecting roller 3 to the outside, a suction box 43 was attached to the liquid collecting roller 3, and a pressure gauge 41 was installed. A pump control device 42 for controlling ON/OFF of a suction pump 44 based on the measured value by the pressure gauge 41 was further provided. In the example, the amount of the liquid component collected in the liquid collecting roller 3 was estimated from the measured pressure value by the pressure gauge 41, and the ON/OFF operation of the suction pump 44 was controlled in response to the estimated result.

Figure 9:
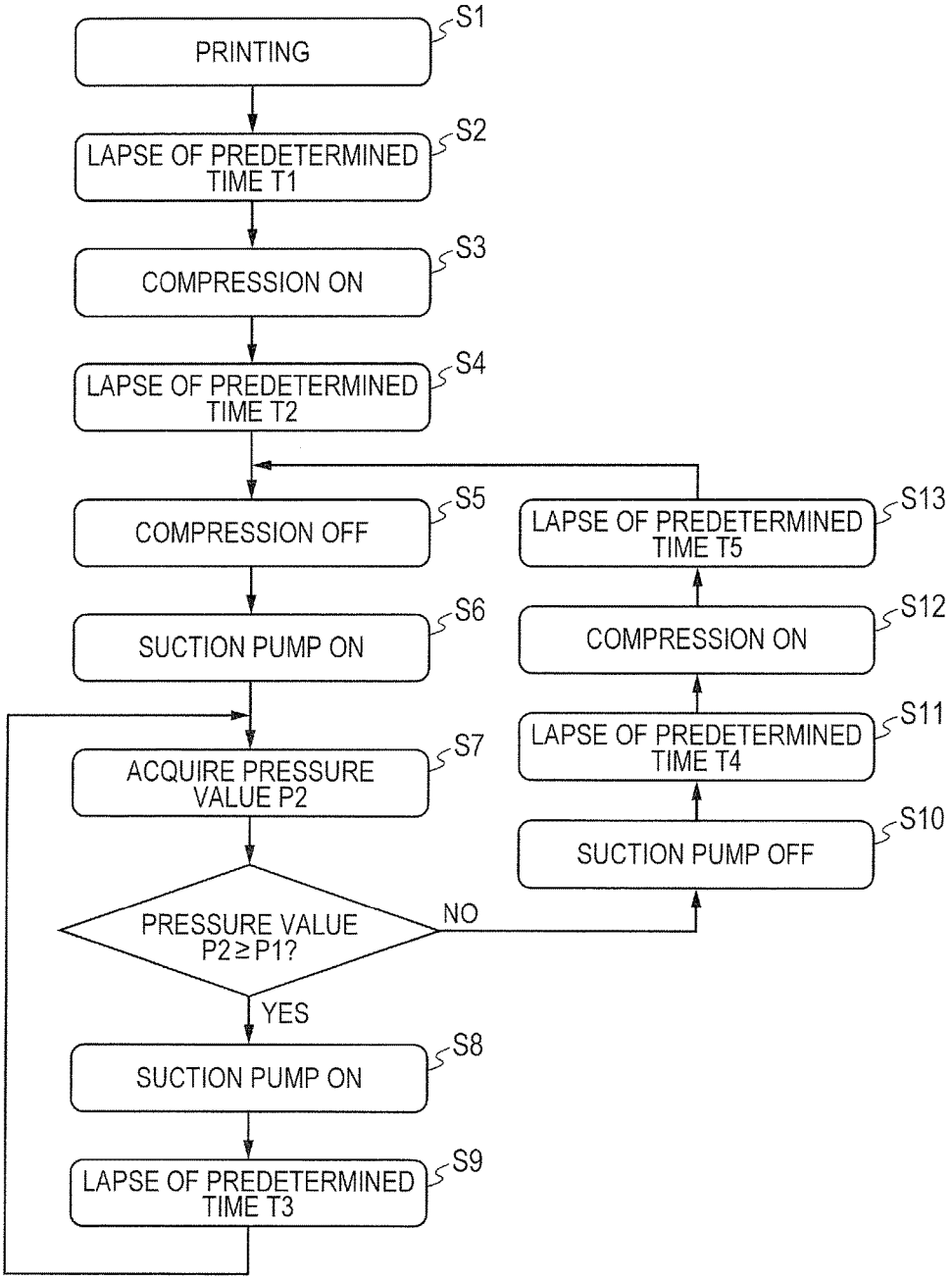
FIG. 9 is an exemplary flowchart showing a liquid collecting method in the present invention.

FIG. 9 is a flowchart for estimating the amount of the liquid component collected in the liquid collecting roller 3 and for removing the liquid component from the liquid collecting roller 3.

Printing is started (step S1), then a lapse of a predetermined time T1 is confirmed (step S2), and compressive force application of the liquid collecting roller 3 against the first porous body 51 is activated (step S3) to collect the liquid component from the first porous body 51 by the liquid collecting roller 3. After a lapse of a predetermined time T2 is confirmed (step S4), the compressive force application of the liquid collecting roller 3 against the first porous body 51 is deactivated (step S5). Next, a suction pump is activated (step S6), and a pressure value P2 is acquired (step S7) while the liquid component is collected from the liquid collecting roller. The P2 is compared with a predetermined pressure value P1, and when the acquired P2 is equal to or more than P1 (Y), the suction pump is continued to be activated (step S8). A lapse of a predetermined time T3 is confirmed (step S9). After the lapse of a predetermined time T3, a pressure value P2 is acquired once again (step S7). As long as the acquired P2 is equal to or more than P1, the suction pump is continued to be driven. Meanwhile, when the pressure value P2 is compared with P1, and P2 is less than P1 (N), the suction pump is deactivated (step S10). A lapse of a predetermined time T4 is confirmed (step S11). After the lapse of a predetermined time T4, the compressive force application is activated once again (step S12). A lapse of a predetermined time T5 is confirmed (step S13), then the compressive force application is deactivated (step S5), and the liquid component collection control is performed in the same flow as above.

[Evaluation]

As described above, the first porous body after the liquid removal from first images was subjected to liquid collection, and the collection rate of the liquid component was calculated from a weight change before and after the liquid collection. In the liquid absorbing step, when the mass of a first porous body after liquid absorption from first images is regarded as W1 (mg), and the mass of a first porous body after liquid collection is regarded as W2 (mg), the collection rate can be calculated in accordance with the equation.

$$\text{Collection rate (\%)}=\{(W1-W2)/W1\}\times 100$$

The calculated collection rate was evaluated on the basis of the following criteria. Criteria AA to B are preferred levels, and criterion C is an unacceptable level. The evaluation results are shown in Table 2.

AA: The collection rate is not less than 60%.

A: The collection rate is not less than 30% and less than 60%.

B: The collection rate is not less than 15% and less than 30%.

C: The collection rate is less than 15%.

Examples 2 and 3

The material of the second porous body used in the liquid collecting roller was changed to materials shown in Table 2 to change the contact angle with water. A series of steps were performed in the same manner as in Example 1 except the above changes, and the collection rates were evaluated.

Example 4

The first porous body was subjected to hydrophilization treatment with PVA so that the first surface of the first porous body would have a lower contact angle with water than the contact angle with water of the second porous body surface. A series of steps were performed in the same manner as in Example 1 except the above change, and the collection rate was evaluated.

Examples 5 to 9

The liquid flow rate, the compressive elastic modulus, and the Gurley value of the second porous body were changed as shown in Table 2. A series of steps were performed in the same manner as in Example 1 except the above changes, and the collection rates were evaluated.

Example 10

For the evaluation at a low line speed, the compression nip time in the liquid collecting step was changed to 100 ms (the conveyance speed was 50 mm/s). A series of steps were performed in the same manner as in Example 1 except the above change, and the collection rate was evaluated.

Example 11

The structure of the first porous body was changed to the structure (b) shown in Table 1, and the liquid flow rate, the compressive elastic modulus, and the Gurley value of the second porous body were changed as shown in Table 2. A series of steps were performed in the same manner as in Example 1 except the above changes, and the collection rate was evaluated.

Comparative Example 1

A porous roller made from PTFE and having a small pore diameter and low breathability was used as the liquid collecting roller. A series of steps were performed in the same manner as in Example 1 except the above change, and the collection rate was evaluated.

Comparative Example 2

A nonporous PE roller was used as the liquid collecting roller. A series of steps were performed in the same manner as in Example 1 except the above change, and the collection rate was evaluated.

Comparative Example 3

A nonporous PE roller was used as the liquid collecting roller and the compression nip time in the liquid collecting step was 100 ms. A series of steps were performed in the same manner as in Example 1 except the above changes, and the collection rate was evaluated.

TABLE 2

| | Liquid collecting roller (second porous body) | | | | | | Liquid collecting step | |
|---|---|---|---|---|---|---|---|---|
| | Feature | Material | Contact angle with water | Liquid flow rate [ml/min/cm$^2$] | Compressive elastic modulus [MPa] | Gurley value [s] | Compression nip time [ms] | Collection rate |
| Example 1 | Porous | EVA | 45° | 30 | 1.4 | 2 | 10 | A |
| Example 2 | | PE | 65° | | 1.2 | 2 | | A |
| Example 3 | | PE (water repellent treatment) | 88° | | | 2 | | A |
| Example 4 (hydrophilized first porous body) | | PE (water repellent treatment) | 88° | | | 2 | | B |
| Example 5 | | EVA | 43° | 60 | 1.5 | 1 | | AA |
| Example 6 | | | | 20 | 1.1 | 3 | | A |
| Example 7 | | | | 5 | 0.8 | 4 | | A |
| Example 8 | | | | 4 | 0.6 | 6 | | B |
| Example 9 | | | | 2 | 0.4 | 10 | | B |
| Example 10 | | | | 4 | 0.6 | 6 | 100 | A |
| Example 11 (the compressive elastic modulus of the first porous body was changed) | | | 45° | 30 | 1.4 | 2 | 10 | B |
| Comparative Example 1 | Porous | PTFE | 118° | 0.5 | 1.8 | 20 | 10 | C |
| Comparative Example 2 | Nonporous | PE | 65° | — | 0.6 | — | 10 | C |
| Comparative Example 3 | | PE | 65° | — | 0.6 | — | 100 | C |

According to the present invention, an ink jet recording apparatus that includes a mechanism of bringing a first porous body into contact with a first image containing a first liquid and a coloring material formed on the surface of an ink receiving medium to absorb and remove a liquid component and enables high-speed collection of the liquid component from the first porous body and an ink jet recording method can be provided. In particular, even when the liquid absorbing member is a porous body having a small pore diameter, the energy load is suppressed, and the liquid component can be reliably collected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-016564, filed Jan. 29, 2016, which is hereby incorporated by reference herein in its entirety.

What is claimed is:

1. An ink jet recording apparatus comprising:

an image forming unit configured to form an ink image by a first liquid and a coloring material on an ink receiving medium;

a liquid absorbing member including a porous body formed into a belt shape having a first surface and a second surface opposite to the first surface, wherein the first surface is configured to come into contact with the ink image and to absorb at least some of the first liquid from the ink image;

a compression member configured to come into contact with the second surface of the porous body in order to compress the second surface for extruding the first liquid from the first surface; and a liquid collecting member configured to collect the first liquid extruded from the first surface by the compression member.

2. The ink jet recording apparatus according to claim 1, wherein the porous body has a multilayer structure including a first layer constituting the first surface and a second layer supporting the first layer.

3. The ink jet recording apparatus according to claim 1, wherein the first liquid contains water, and a surface of the liquid collecting member has a contact angle with water smaller than a contact angle with water of the first surface of the porous body.

4. The ink jet recording apparatus according to claim 1, wherein the liquid collecting member has a compressive elastic modulus larger than a compressive elastic modulus of the liquid absorbing member.

5. The ink jet recording apparatus according to claim 1, wherein the liquid collecting member has a liquid flow rate of IPA (isopropyl alcohol) larger than a liquid flow rate of IPA of the liquid absorbing member.

6. The ink jet recording apparatus according to claim 1, wherein a relation:

$$0.5 \times G1 \geq G2$$

is satisfied, where G1 is a Gurley value of the liquid absorbing member in accordance with JIS P8117, and G2 is a Gurley value of the liquid collecting member in accordance with JIS P8117.

7. The ink jet recording apparatus according to claim 1, wherein the image forming unit includes a first applying device configured to apply a first liquid composition containing the first liquid or a second liquid onto the ink receiving medium, and a second applying device configured to apply a second liquid composition containing the first liquid or the second liquid and the coloring material onto the ink receiving medium, and the first image is a mixture of the first liquid composition and the second liquid composition and is more viscous and thicker than the first liquid composition and than the second liquid composition.

8. The ink jet recording apparatus according to claim 1, wherein the ink receiving medium is a transfer body configured to temporarily hold the ink image, and the ink image having at least some of the first liquid absorbed by the liquid absorbing member is transferred onto a recording medium on which an image is to be formed.

9. The ink jet recording apparatus according to claim 8, wherein the first surface contacts the ink image and absorbs at least some of the first liquid from the ink image so that ink forming the ink image is concentrated.

10. The ink jet recording apparatus according to claim 1, wherein the ink receiving medium is a recording medium on which an image is to be formed.

11. The ink jet recording apparatus according to claim 1, wherein the liquid collecting member includes a porous body configured to absorb the first liquid extruded from the first surface by the compression member.

12. The ink jet recording apparatus according to claim 1, wherein the compression member is arranged on the side of the second surface, and the liquid collecting member is arranged on the side of the first surface.

13. An ink jet recording apparatus comprising:

an image forming unit configured to form an ink image by an aqueous liquid component and a coloring material on an ink receiving medium;

a liquid absorbing member including a porous body formed into a belt shape having a first surface and a second surface opposite to the first surface, wherein the first surface is configured to come into contact with the ink image and to absorb at least some of the aqueous liquid component from the ink image for concentrating an ink constituting the ink image; and a compression member configured to come into contact with the second surface of the porous body in order to compress the second surface for extruding the aqueous liquid component from the first surface; and a liquid collecting member configured to collect the aqueous liquid component extruded from the first surface by the compression member.

14. An ink jet recording method comprising:

a forming step of forming an ink image by a first liquid and a coloring material on an ink receiving medium;

a liquid absorbing step of bringing a first surface of a liquid absorbing member, which includes a porous body formed into a belt shape having the first surface and a second surface opposite to the first surface, into contact with the ink image to allow the liquid absorbing member to absorb at least some of the first liquid from the ink image;

a compression step of bringing a compression member into contact with the second surface of the porous body in order to compress the second surface for extruding the first liquid from the first surface; and a liquid collecting step of collecting the first liquid extruded from the first surface by the compression member into a liquid collecting member.

15. The ink jet recording method according to claim 14, wherein the porous body has a multilayer structure including a first layer constituting the first surface and a second layer supporting the first layer.

16. The ink jet recording method according to claim 14, wherein the first liquid contains water, and a surface of the liquid collecting member has a contact angle with water smaller than a contact angle with water of the first surface of the porous body.

17. The ink jet recording method according to claim 14, wherein the liquid collecting member has a compressive elastic modulus larger than a compressive elastic modulus of the liquid absorbing member.

18. The ink jet recording method according to claim 14, wherein the liquid collecting member has a liquid flow rate of IPA (isopropyl alcohol) larger than a liquid flow rate of IPA of the liquid absorbing member.

19. The ink jet recording method according to claim 14, wherein a relation:

$$0.5 \times G1 \geq G2$$

is satisfied, where G1 is a Gurley value of the liquid absorbing member in accordance with JIS P8117, and G2 is a Gurley value of the liquid collecting member in accordance with JIS P8117.

20. The ink jet recording method according to claim 14, wherein the ink image is a mixture of a first liquid composition containing the first liquid or a second liquid and a second liquid composition containing the first liquid or the second liquid and the coloring material and is more viscous and thicker than the first liquid composition and than the second liquid composition.

21. The ink jet recording method according to claim 20, wherein the forming step includes a first applying step of applying the first liquid composition onto the ink receiving medium and a second applying step of applying the second liquid composition onto the ink receiving medium on which the first liquid composition has been applied.

22. The ink jet recording method according to claim 14, wherein the ink receiving medium is a transfer body configured to temporarily hold the ink image, and the ink image having at least some of the first liquid absorbed by the liquid absorbing member is transferred onto a recording medium on which an image is to be formed.

23. The ink jet recording method according to claim 14, wherein the ink receiving medium is a recording medium on which an image is to be formed, and wherein the liquid absorbing member forms a second image obtained by absorbing at least some of the first liquid from the ink image on the recording medium.

24. An ink jet recording method comprising:

a forming step of forming an ink image by an aqueous liquid component and a coloring material on an ink receiving medium;

a liquid absorbing step of bringing a first surface of a liquid absorbing member, which includes a porous body formed into a belt shape having the first surface and a second surface opposite to the first surface, into contact with the ink image to allow the liquid absorbing member to absorb at least some of the aqueous liquid component from the ink image, thereby concentrating an ink constituting the ink image; and a compression step of bringing a compression member into contact with the second surface of the porous body in order to compress the second surface for extruding the aqueous liquid component from the first surface; and a liquid collecting step of collecting the liquid extruded from the first surface by the compression member into a liquid collecting member.

25. An ink jet recording apparatus comprising:

an image forming unit configured to form an ink image by an aqueous liquid component and a coloring material on an ink receiving medium;

a liquid absorbing member having a belt shape with a first surface and a second surface opposite to the first surface, wherein the first surface is configured to come into contact with the ink image and to absorb at least some of the aqueous liquid component from the ink image for concentrating an ink constituting the ink image;

a compression member configured to come into contact with the second surface in order to compress the second surface for extruding the aqueous liquid component from the first surface; and a liquid collecting member configured to collect the aqueous liquid component extruded from the first surface by the compression member, wherein the ink receiving medium is a transfer body configured to temporarily hold the ink image, and the ink image having at least some of the aqueous liquid component absorbed by the liquid absorbing member is transferred onto a recording medium on which an image is to be formed.

26. An ink jet recording apparatus comprising:

an image forming unit configured to form an ink image by an aqueous liquid component and a coloring material on an ink receiving medium;

a liquid absorbing member having a belt shape with a first surface and a second surface opposite to the first surface, wherein the first surface is configured to come into contact with the ink image and to absorb at least some of the aqueous liquid component from the ink image for concentrating an ink constituting the ink image;

a compression member configured to come into contact with the second surface in order to compress the second surface for extruding the aqueous liquid component from the first surface; and a liquid collecting member configured to collect the aqueous liquid component extruded from the first surface by the compression member, wherein the liquid collecting member includes a porous body configured to absorb the aqueous liquid component extruded from the first surface by the compression member.

27. The ink jet recording apparatus according to claim 26, wherein the ink receiving medium is a transfer body configured to temporarily hold the ink image, and the ink image having at least some of the aqueous liquid component absorbed by the liquid absorbing member is transferred onto a recording medium on which an image is to be formed.

* * * * *